US011034576B2

(12) United States Patent
Smith et al.

(10) Patent No.: US 11,034,576 B2
(45) Date of Patent: Jun. 15, 2021

(54) UPHOLSTERY SYSTEMS AND METHODS FOR FORMING A CURVED SURFACE

(71) Applicant: Steelcase Inc., Grand Rapids, MI (US)

(72) Inventors: Bruce Smith, Grand Rapids, MI (US); Ryan McGovern, Grand Rapids, MI (US); Rolf Pascal Hien, Radebeul (DE); Mark Spoelhof, Grand Rapids, MI (US); Greg Opatik, Grand Rapids, MI (US); Kade Roggentine, Byron Center, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 16/667,459

(22) Filed: Oct. 29, 2019

(65) Prior Publication Data

US 2020/0062582 A1 Feb. 27, 2020

Related U.S. Application Data

(63) Continuation of application No. PCT/US2018/032735, filed on May 15, 2018.
(Continued)

(51) Int. Cl.
*B68G 7/052* (2006.01)
*B68G 7/10* (2006.01)
*A47C 31/02* (2006.01)

(52) U.S. Cl.
CPC ..... *B68G 7/052* (2013.01); *A47C 31/02* (2013.01); *B68G 7/10* (2013.01)

(58) Field of Classification Search
CPC .. B68G 7/052; B68G 7/10; B68G 7/12; A47C 31/02; A47C 31/023; B60N 2/58; B60N 2/5816
(Continued)

(56) References Cited

U.S. PATENT DOCUMENTS 7,469,968 B2 * 12/2008 Hazlewood ..... B60N 2/58 297/452.58
10,500,995 B2 * 12/2019 Ohtsu ..... B60N 2/5883
(Continued)

FOREIGN PATENT DOCUMENTS

DE 20 2011 100 886 U1 9/2011
DE 10 2012 023 773 A1 6/2014
(Continued)

OTHER PUBLICATIONS

International Search Report and Written Opinion for PCT/US2018/032735, dated Sep. 10, 2018.

*Primary Examiner* — Mark R Wendell
(74) *Attorney, Agent, or Firm* — Brinks Gilson & Lione

(57) ABSTRACT

An upholstery system for forming a curved furniture surface includes two surfaces that form a corner, two planar elements that are each positioned on one of the two surfaces, and a plurality of contoured elements positioned between the two planar elements and along the corner. Each of the plurality of contoured elements includes a curved surface. The system also includes at least one piece of fabric that includes at least three sections, which are connected to each other in a series such that adjacent sections form a connection portion. The system further includes a plurality of clips positioned on each of the two surfaces. The at least three sections of the at least one piece of fabric are positioned over the planar elements and the plurality of contoured elements. The connected portion of adjacent sections of the at least one piece of fabric is connected to the plurality of clips.

21 Claims, 21 Drawing Sheets

Related U.S. Application Data

(60) Provisional application No. 62/511,764, filed on May 26, 2017.

(58) Field of Classification Search
USPC ..... 297/452.58
See application file for complete search history.

(56) References Cited

U.S. PATENT DOCUMENTS

| | | | | |
|---|---|---|---|---|
| 2007/0257531 | A1* | 11/2007 | Mashimo | B60N 2/5825 297/218.3 |
| 2008/0164742 | A1* | 7/2008 | Crowe | A47C 4/02 297/440.14 |
| 2012/0284974 | A1 | 11/2012 | Yamamoto et al. | |

FOREIGN PATENT DOCUMENTS

| | | | |
|---|---|---|---|
| EP | 0 784 953 | A1 | 7/1997 |
| JP | 2011 121426 | A | 6/2011 |
| WO | WO 01/50920 | A1 | 7/2001 |

* cited by examiner

UPHOLSTERY SYSTEMS AND METHODS FOR FORMING A CURVED SURFACE

CROSS-REFERENCE TO RELATED APPLICATION

This application claims priority to and the benefit of U.S. Provisional Application No. 62/511,764, filed May 26, 2017, and to PCT Application No. PCT/US2018/032735, filed May 15, 2018, each of which is incorporated by reference herein in its entirety.

BACKGROUND

1. Technical Field Text

The present embodiments relate to upholstery systems, methods for forming a curved surface on furniture and applying upholstery to the curved surface, and devices for use with furniture. The present embodiments also relate to a screen connector for connecting adjacent elements of furniture and a furniture glide.

2. Background Information

Furniture may include a seating surface and a surface to support the back. The seating surface and the back support surface form an approximately 90-degree or larger angle with each other when the furniture is assembled to form a corner. Fabric may be applied to the seating surface and the back support surface separately such that the fabric of the seating surface and the fabric of the back support surface are not connected to each other. In this configuration, the corner between the seating and back support surfaces is often sharp, and the fabric between the seating and back support surfaces is discontinuous. A need exists for an upholstery method and system that provides a smooth, curved, and contoured surface between the seating and back support surfaces of furniture and an application of fabric to the smooth, curved, and contoured surface that is continuous.

BRIEF SUMMARY

The presently disclosed embodiments concern upholstery systems and methods used for applying upholstery to a curved surface and forming a curved surface on furniture, and devices for use with furniture.

In one aspect, the present embodiments relate to an upholstery system for forming a curved surface. The system includes two surfaces that form a corner, first and second planar elements, wherein each planar element is positioned on one of the two surfaces. The system also includes a plurality of contoured elements positioned between the first and second planar elements and along the corner, wherein each of the plurality of contoured elements comprises a curved surface. The system also includes at least one piece of fabric, wherein the at least one piece of fabric comprises at least three sections, and wherein the at least three sections are connected to each other in a series such that adjacent sections form a connected portion. The system further includes a plurality of clips positioned on each of the two surfaces so that at least one clip is disposed between the first planar element and the plurality of contoured elements and at least one clip is disposed between the second planar element and the plurality of contoured elements. The at least three sections of the at least one piece of fabric are positioned over the planar elements and the plurality of contoured elements, and the connected portion of adjacent sections of the at least one piece of fabric is connected to the plurality of clips.

In another aspect, the present embodiments relate to a system for forming a curved surface. The system includes three surfaces that form three corners. The first and second of the three surfaces form the first corner, the first and third surfaces form the second corner, and the first, second, and third surfaces form the third corner. The system also includes first, second, and third planar elements. Each planar element is positioned on one of the three surfaces. The system also includes a plurality of contoured elements positioned along the first corner between the first and second planar elements and along the second corner between the first and third planar elements. Each of the plurality of contoured elements comprises a curved surface. The system also includes a plurality of clips positioned on each of the three surfaces so that at least one clip is disposed between the first planar element and the plurality of contoured elements, at least one clip is disposed between the plurality of contoured elements and the second planar element, at least one clip is disposed between the plurality of contoured elements and the third planar element, and at least one clip is disposed between the second and third planar elements. The system further includes at least one piece of fabric that includes at least four sections of fabric. The at least four sections of the at least one piece of fabric are connected to cover the three planar elements and the plurality of contoured elements. Adjacent sections of fabric form a connected portion. The connected portion of adjacent sections of fabric is connected to the plurality of clips.

In another aspect, the present embodiments relate to an upholstery method for forming a curved surface. The method includes presenting two surfaces that form a corner, presenting two planar elements, positioning each planar element on one of the two surfaces, presenting a plurality of contoured elements, and positioning the plurality of contoured elements between the two planar elements and along the corner. Each of the plurality of contoured elements comprises a curved surface. The method also includes presenting a plurality of clips, positioning the plurality of clips on the two surfaces between a first of the two planar elements and the plurality of contoured elements and between a second of the two planar elements and the plurality of contoured elements, presenting a piece of fabric comprising at least three sections, connecting the three sections of fabric to each other in a series such that adjacent sections of fabric form a connected portion, and positioning the three sections of fabric over the curved surfaces of the two planar elements and the plurality of contoured elements. The method further includes connecting the connected portion of adjacent sections of fabric to the plurality of clips.

In another aspect, the present embodiments relate to a connector for connecting two adjacent surfaces, each having a loop that extends from the adjacent surface. The connector includes a housing and a clip that are removably connected to each other. The housing includes a cavity to accommodate the clip. The clip includes at least three members. Two of the at least three members are parallel to each other, and the third of the at least three members connects the two parallel members of the at least three members. When the connector is in a connected state, one of the two parallel members is coupled to the loop of one of the adjacent surfaces, and the second of the two parallel members is coupled to the loop of the second of the adjacent surfaces. In the connected state, the clip is positioned within the housing.

In another aspect, the present embodiments relate to a glide for furniture. The glide includes a first portion and a second portion that are removably connected to each other. The first portion includes a top surface and a bottom surface. The bottom surface includes at least two protruding portions that extend from the bottom surface. The second portion includes a top surface, a bottom surface, and at least two cavities. In a connected state, the at least two protruding portions are positioned within the at least two cavities of the second portion to connect the first and second portions together. The second portion includes a recess that allows for the first and second portions to be removed from each other.

The accompanying drawings, which are incorporated herein and constitute part of this specification and, together with the general description given above and the detailed description given below, serve to explain features of the embodiments disclosed herein.

DETAILED DESCRIPTION OF THE DRAWINGS AND THE PRESENTLY PREFERRED EMBODIMENTS

Figure 1:
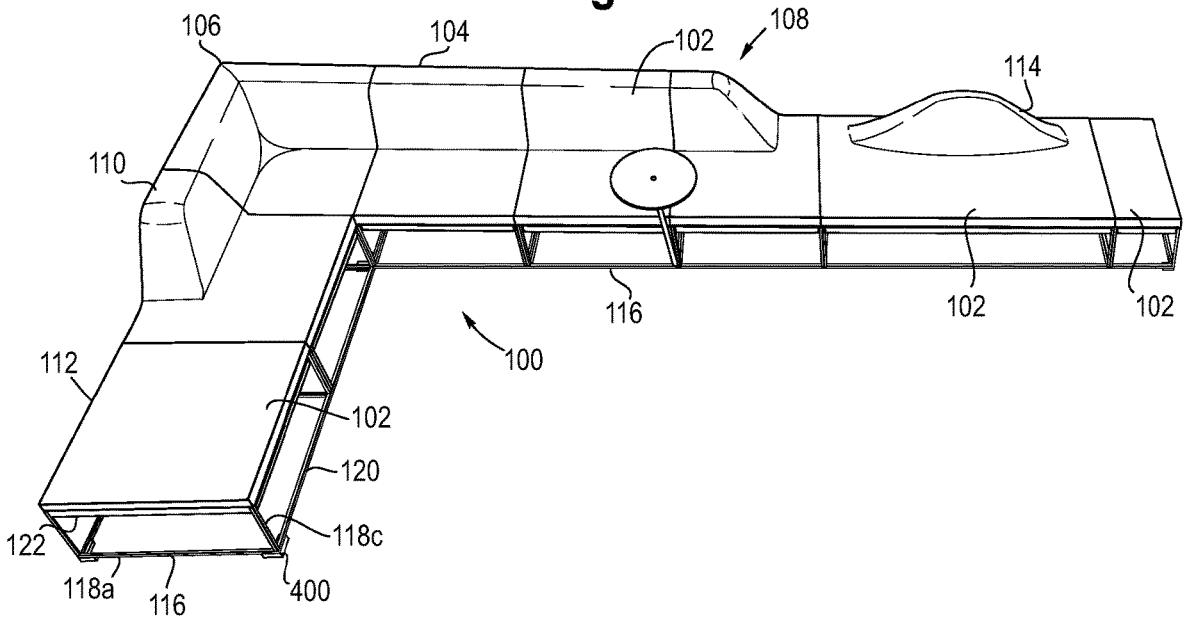
FIG. 1 shows a perspective view of an embodiment of modular furniture incorporating an embodiment of an upholstery system for forming a curved surface.

In the following detailed description of the various upholstery method and system embodiments, like elements and structures are numbered and/or labeled alike. The relationship and functioning of the various elements of the embodiments may better be understood by reference to the following detailed description. However, embodiments are not limited to those illustrated in the drawings. It should be understood that the drawings may be, but are not necessarily to scale, and in certain instances details may have been omitted that are not necessary for an understanding of embodiments disclosed herein, such as—for example—conventional fabrication and assembly.

The invention is defined by the claims, may be embodied in many different forms, and should not be construed as limited to the embodiments set forth herein; rather, these embodiments are provided so that this disclosure will be thorough and complete, and will fully convey enabling disclosure to those skilled in the art. As used in this specification and the claims, the singular forms "a," "an," and "the" include plural referents unless the context clearly dictates otherwise. Reference herein to any industry standards (e.g., ASTM, ANSI, IEEE standards) is defined as complying with the currently published standards as of the original filing date of this disclosure concerning the units, measurements, and testing criteria communicated by those standards unless expressly otherwise defined herein.

The terms "about," "substantially," "generally," and other terms of degree, when used with reference to any volume, dimension, proportion, or other quantitative or qualitative value, are intended to communicate a definite and identifiable value within the standard parameters that would be understood by one of skill in the art (equivalent to a furniture design engineer or other professional with experience in this field), and should be interpreted to include at least any legal equivalents, minor but functionally-insignificant variants, standard manufacturing tolerances, and including at least mathematically significant figures (although not required to be as broad as the largest range thereof).

The present embodiments of an upholstery method and system advantageously allow for a smooth, curved, and contoured application of upholstery for various types of furniture. For example, in furniture for seating, the upholstery method and system creates a curved contoured surface between a seating surface and a back support that provides for increased lumbar support. Also, the present embodiments eliminate or minimize crevices between two adjoining surfaces, such as between a seating surface and a back surface or between two panels. As another advantage, the present embodiments of the upholstery method and system also provide for an application of upholstery to the curved contoured surface that is generally continuous and allows for the application of upholstery around multiple types of curved surfaces.

Upholstery Method and System—Corner Furniture Unit

FIG. 1 shows an embodiment of a modular furniture system 100 that includes a plurality of furniture units 102 that may be removably connected to each other and arranged in various different configurations. The plurality of furniture units 102 includes a non-corner furniture unit 104, a corner furniture unit 106, a left end furniture unit 108, a right end furniture unit 110, a no-back furniture unit 112, and a centered-back furniture unit 114.

Each of the plurality of furniture units 102 comprises a support frame 116. The support frame 116 comprises a plurality of bars 118. In one example, the plurality of bars 118 form a square shape including four bars 118*a* to form the base portion 120 of the support frame 116, four bars (not shown) to form the upper portion 122 of the support frame 116, and four bars 118*c* that are vertically arranged to connect the bars 118*a* of the base portion 120 to the bars of the upper portion 122. In one embodiment, the bars 118 may include a plurality of tubes, and in a second embodiment, the bars 118 may include squared shaped solid structures. The material for the bars 118 may include any type of metal such as sheet metal, iron or carbon and/or any type of alloy such as steel. The bars 118 may be fixedly connected to each other via welding and/or mechanically connected to each other. When the bars 118 are connected via welding, other materials for the bars 118 known in the art may be used that allow the bars 118 to connect to each other via welding. The support frame 116 is described in further detail below regarding an embodiment of a frame glide.

Each of the plurality of furniture units 102 includes a support surface 124 for seating that is connected to the bars that form the upper portion 122 of the support frame 116. The non-corner furniture unit 104, the corner furniture unit 106, the left end furniture unit 108, the right end furniture unit 110, and the centered-back furniture unit 114 also each include a support surface 126 for back support. The shape of the support surface 126 for back support may vary for each of the plurality of furniture units 102. To form a curved surface between the support surface 124 for seating and the support surface 126 for back support, an upholstery method and system is used that is described in further detail below.

Figure 2:
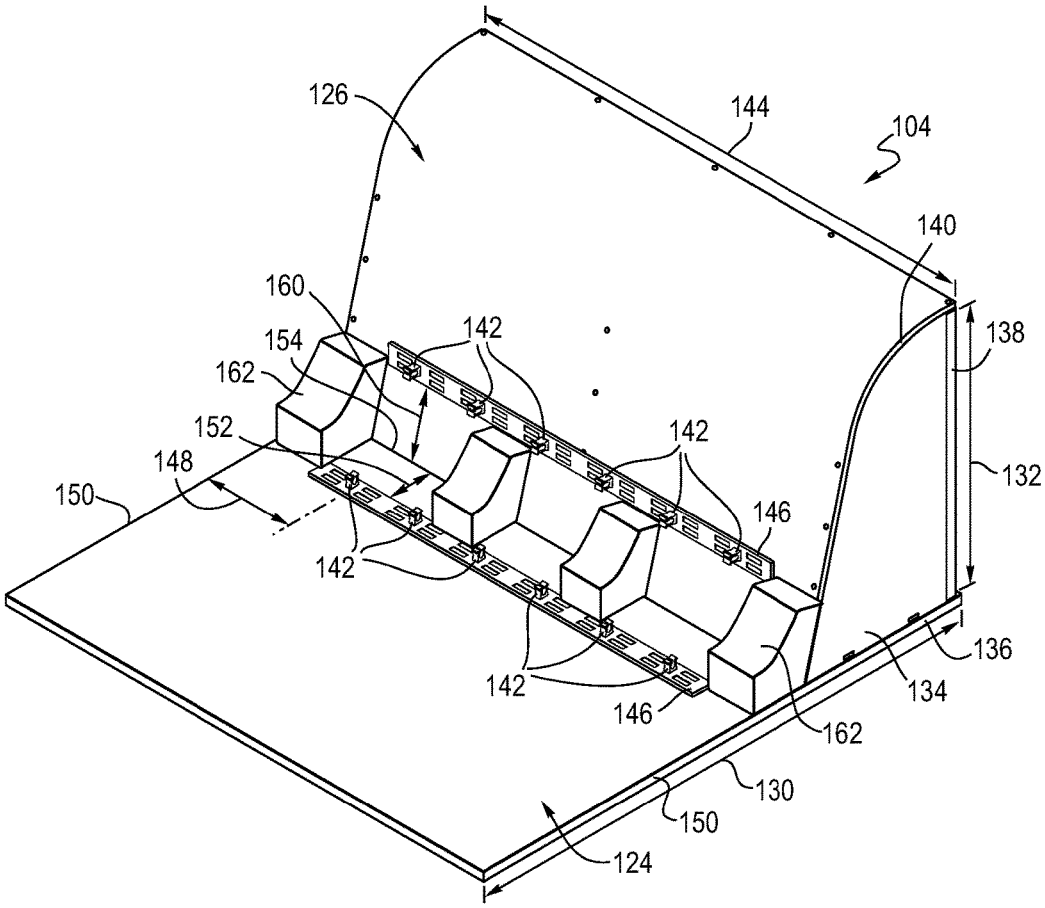
FIG. 2 shows a perspective view of an embodiment of a non-corner unit of the modular furniture of FIG. 1 including a plurality of contoured elements.

FIG. 2 shows a non-corner furniture unit 104 including a first surface or a support surface 124 for seating and a second surface or a support surface 126 for back support. The support surface 124 for seating includes a generally square-shaped and flat surface. The material for the support surface 124 for seating may include plywood, wood or other building material that may be formed to create a square-shaped flat surface. The non-corner furniture unit 104 also includes a back panel 128 that forms a generally square-shaped and flat surface. The material for the back panel 128 may include plywood, wood or other building material that may be formed to create a square-shaped flat surface. The support surface 124 for seating is connected to the back panel 128, which is arranged perpendicular to the support surface 124 for seating. For example, the support surface 124 for seating is positioned in an x-plane or horizontal plane 130 and the back panel 128 is positioned in a y-plane or vertical plane 132.

The non-corner furniture unit 104 also includes a pair of side panels 134 that are positioned on the support surface 124 for seating and adjacent to opposing edges 150 of the support surface 124. The pair of side panels 134 are positioned in the vertical plane 132 and extend from the back panel 128 in the direction of the horizontal plane 130, as shown in FIG. 2. The material for the pair of side panels 134 may include plywood, wood or other building material that may be formed to create a flat surface. The pair of side panels 134 each include first 136 and second 138 edges that are generally flat and form a 90 degree angle with each other. The pair of side panels 134 also each include a third edge 140 that is curved or generally convex and extends from the first edge 136 to the second edge 138.

The support surface 126 for back support comprises a rigid contoured element that is vacuum molded. The material for the support surface 126 may include a thermoplastic, a plastic, or other material capable of being vacuum molded. The support surface 126 for back support extends from the support surface 124 for seating along the third edge 140 of each of the pair of side panels 134 to the back panel 128. The support surface 126 for back support is contoured to align with the curved or generally convex third edge 140 of each of the pair of side panels 134. The support surface 126 is connected to the third edge 140 of each of the pair of side panels 134 and may also be connected to a top portion of the back panel 128 to form an enclosed space. The support surface 126 may be connected to the third edge 140 of each of the pair of side panels 134 and the top portion of the back panel 128 by any form of connection that binds them together, including any form of mechanical connection such as screws, bolts, or nails and/or any form of adhesive or permanent connection such as glue or paste.

Figure 12:
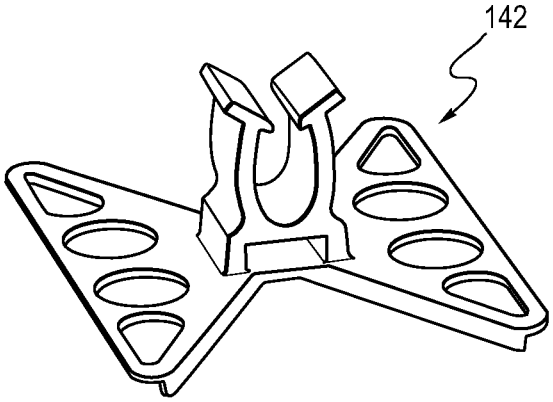
FIG. 12 shows a perspective view of one of the plurality of clips.

To adhere upholstery to the non-corner furniture unit 104, an embodiment of an upholstery system 141 includes a plurality of clips 142 that are arranged on the support surface 124 for seating in a series along a z-plane 144 and on the support surface 126 for back support in a series along the z-plane 144, as shown in FIG. 2. The z-plane 144 is perpendicular to the horizontal plane 130 and to the vertical plane 132. The plurality of clips 142 are spaced apart from each other within the series and may include individual clips, such as shown in FIGS. 12-13, 15 and 17-19 or the plurality of clips 142 may be arranged on an elongated bracket or strip 146, such as show in FIGS. 2, 9A-9C and 10. FIG. 12 shows a perspective view of an individual clip 142. The plurality of clips 142 positioned on the support surface 124 for seating are positioned a length 148 from opposing edges 150 of the support surface 124 and a length 152 from a corner 154 where the support surface 124 for seating and the support surface 126 for back support meet. Similarly, the plurality of clips 142 positioned on the support surface 126 for back support are positioned a length 156 from opposing edges 158 of the support surface 126 for back support and a length 160 from the corner 154. In one embodiment, the plurality of clips 142 are adhesively connected to the support surface 124 for seating and the support surface 126 for back support, and in a second embodiment, the plurality of clips 142 are mechanically connected to the support surface 124 for seating and the support surface 126 for back support.

The upholstery system 141 also includes a plurality of contoured elements 162. The material of the plurality of contoured elements 162 includes any type of foam, such as polyurethane, high density, closed cell, latex rubber, or high resilience foam, or any type of cushion material that provides a firm and resilient surface. The plurality of contoured elements 162 each include a plurality of surfaces and are shaped to align with the shape of the corner 154 where the support surface 124 for seating and the support surface 126 for back support meet. The plurality of contoured elements 162 are adhesively connected to the support surface 124 for seating and the support surface 126 for back support.

Figure 8:
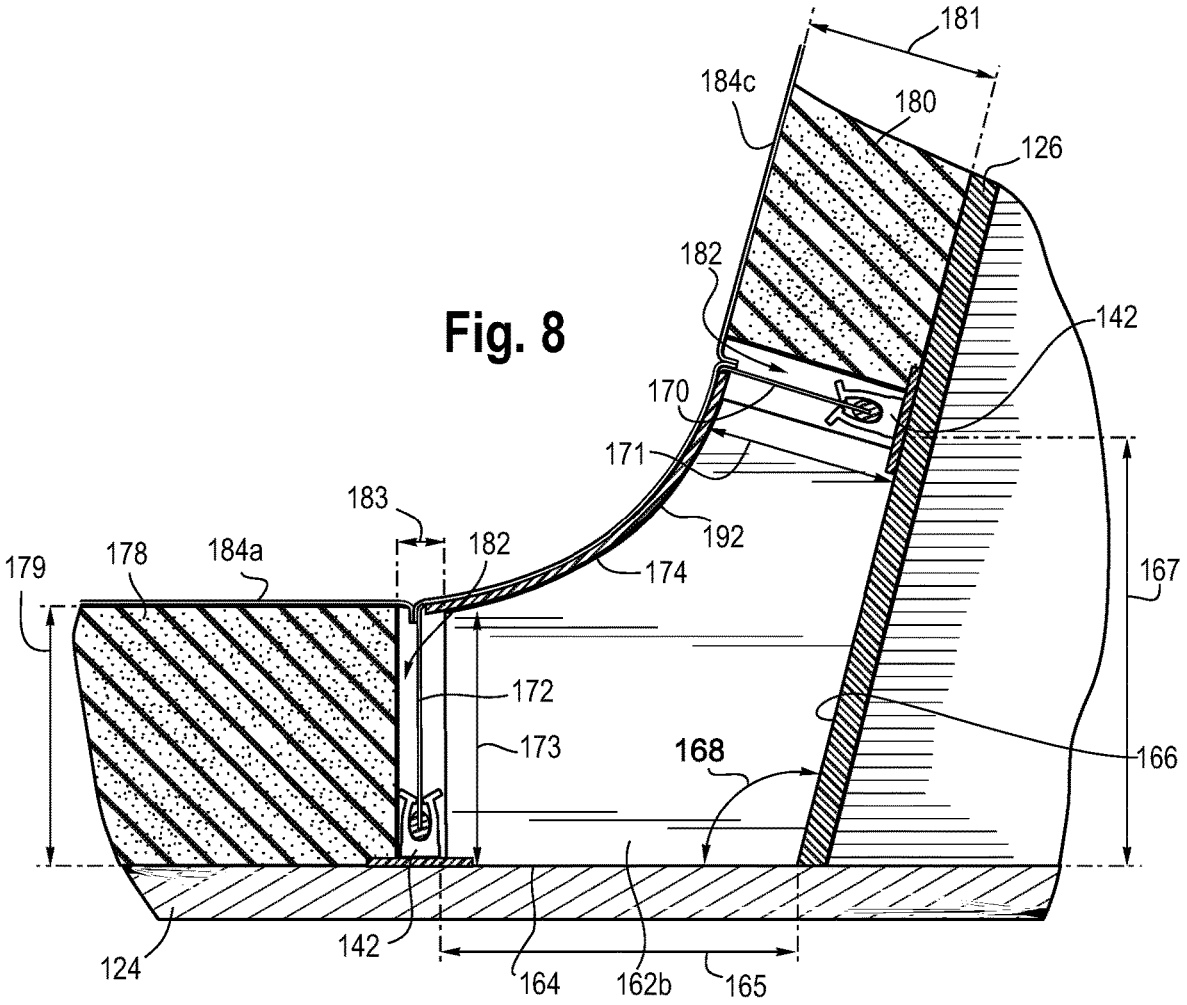
FIG. 8 shows a detailed call-out view taken of the region identified by line 8 of FIG. 7.

A first surface 164 of the plurality of contoured elements 162 is generally flat and positioned along the support surface 124 for seating for a length 165. A second surface 166 of the plurality of contoured elements 162 is generally flat and positioned along the support surface 126 for back support for a length 167 as shown in FIG. 8. The second surface 166 extends at an angle 168 from the first surface 164. In one embodiment, as shown in FIG. 2, the angle 168 is greater than 90 degrees from the first surface 164, and in a second embodiment, the angle 168 is approximately equal to 90 degrees from the first surface 164. A third surface 170 of the plurality of contoured elements 162 extends from the second surface 166 for a length 171 and away from the support surface 126 for back support. The third surface 170 is generally flat and generally parallel to the support surface 124 for seating. A fourth surface 172 of the plurality of contoured elements 162 extends for a length 173 from the first surface 164 and away from the support surface 124 for seating. The fourth surface 172 is generally flat and generally parallel to the back panel 128. A fifth surface 174 of the plurality of contoured elements 162 includes a curved and convex shape that extends between the third surface 170 and the fourth surface 172. The plurality of contoured elements also includes a pair of opposing surfaces 176 that extend from the first surface 164 and the second surface 166 to the fifth surface 174, as shown in FIG. 2.

The plurality of contoured elements 162 is positioned along the corner 154 where the support surface 124 for seating and the support surface 126 for back support meet. In other words, the first surface 164 of each of the plurality of contoured elements 162 is flush against the support surface 124 for seating and the second surface 166 of each of the plurality of contoured elements 162 is flush against the support surface 126 for back support.

Two of the plurality of contoured elements 162, also referred to as the pair of end contoured elements **162*a* are positioned adjacent to the opposing edges 150 of the support surface 124, and one or more of the plurality of contoured elements 162, also referred to as the middle contoured elements 162*b*, are positioned between the pair of end contoured elements 162*a* and spaced apart from each other. For reasons described below, the dimensions of the pair of end contoured elements 162*a* are greater than the middle contoured elements 162*b*, and the shape of the pair of end contoured elements 162*a* and the middle contoured elements 162*b* is the same as described above for the plurality of contoured elements 162. For example, the length 165 of the first surface 164 of the pair of end contoured elements 162*a* is greater than the length 165 of the first surface 164 of the middle contoured elements 162*b*, and the length 167 of the second surface 166 of the pair of end contoured elements 162*a* is greater than the length 167 of the second surface 166 of the middle contoured elements 162*b***.

One of the pair of end contoured elements **162*a* is positioned adjacent to one of the opposing edges 150 of the support surface 124 such that there is minimal to no distance between the opposing edge 150 and the end contoured element 162*a*. The second of the pair of end contoured elements 162*a* is also positioned adjacent to the other of the opposing edges 150 of the support surface 124 such that there is minimal to no distance between the opposing edge 150 and the least one of the plurality of contoured elements 162. In one embodiment, the distance between adjacent contoured elements 162 is generally equal. In other embodiments, the distance between adjacent contoured elements 162 may vary depending on the shape of the support surface 126 for back support of the furniture unit 102**.

Figure 3:
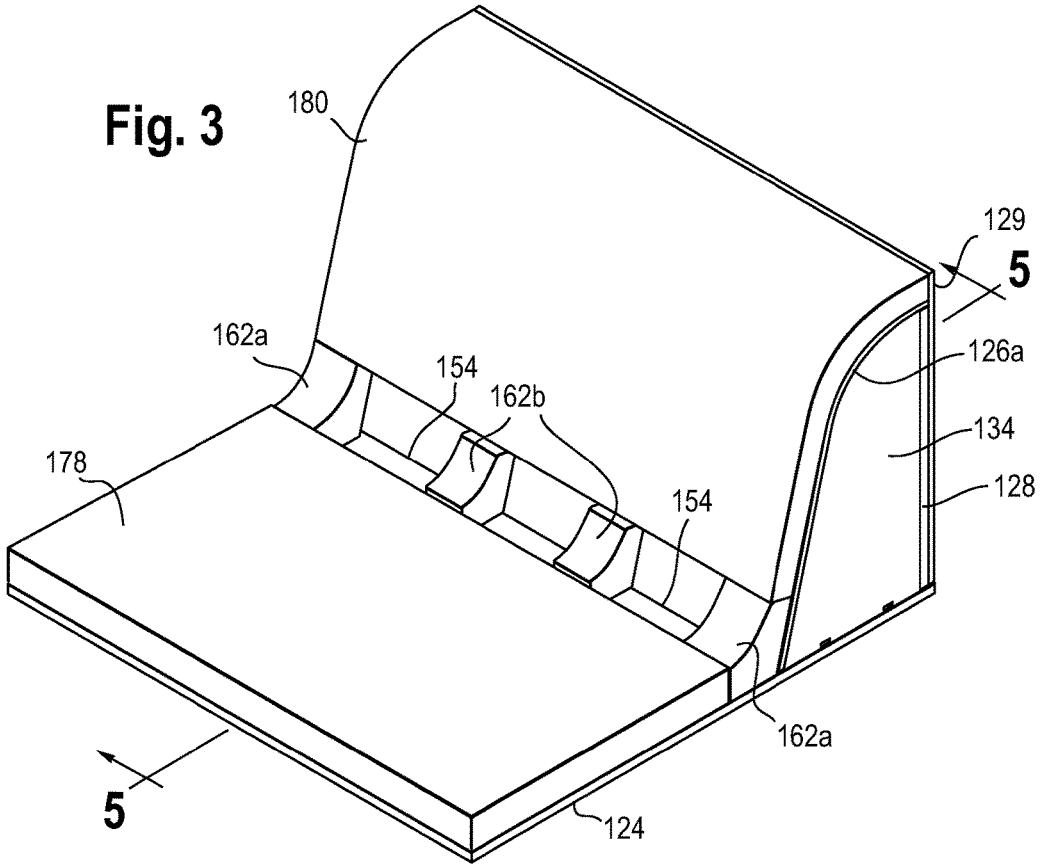
FIG. 3 shows a perspective view of the non-corner unit of FIG. 2 including two planar elements.

The upholstery system 141 also includes a first planar element 178 and a second planar element 180, as shown in FIG. 3, that are each generally flat and squared-shaped. The material of the first planar element 178 and the second planar element 180 includes any type of foam, such as polyurethane, high density, closed cell, latex rubber, or high resilience foam, or any type of cushion material that provides a firm and resilient surface.

The first planar element 178 is positioned on the support surface 124 for seating and adjacent to the fourth surface 172 of the pair of end contoured elements **162*a* such that the pair of end contoured elements 162*a* and the first planar element 178 form a continuous surface. Specifically, the first planar element 178 has a height 179, and the height 179 of the first planar element 178 is the same as the length 173 of the fourth surface 172, as shown in FIG. 8. The first planar element 178 is adhesively connected to the support surface 124 for seating. As described above, the middle contoured elements 162*b* have smaller dimensions than the pair of end contoured elements 162*a*. Thus, a gap 182 having a width 183 exists between the first planar element 178 and the fourth surface 172 of the middle contoured elements 162*b*. The width 183 of the gap 182 is minimal yet sufficient to allow the plurality of clips 142 to be positioned between the first planar element 178 and the fourth surface 172 of the middle contoured elements 162***b*.

The second planar element 180 is positioned on the support surface 126 for back support and adjacent to the third surface 170 of the plurality of contoured elements 162. The second planar element 180 is positioned adjacent to the third surface 170 of the pair of end contoured elements 162*a* such that the pair of end contoured elements 162*a* and the second planar element 180 form a continuous surface. Specifically, the second planar element 180 has a height 181, and the height 181 of the second planar element 180 is the same as the length 171 of the third surface 170, as shown in FIG. 8. The second planar element 180 is adhesively connected to the support surface 126 for back support and is capable of being shaped to form the shape of the support surface 126 for back support. As described above, the middle contoured elements 162*b* have smaller dimensions than the pair of end contoured elements 162*a*, and the gap 182 having the width 183 exists between the second planar element 180 and the third surface 170 of the middle contoured elements 162*b*. Also as described above regarding the positioning of the first planar element 178, the width 183 of the gap 182 is minimal yet sufficient to allow the plurality of clips 142 to be positioned between the second planar element 180 and the third surface 170 of the middle contoured elements 162.

The upholstery system 141 may also include an additional planar element 129 that is generally flat, squared-shaped, and thinner than the first and second planar elements 178, 180, as shown in FIGS. 3-8. The additional planar element 129 extends along the back panel to the top of the second planar element 180. The material of the additional planar element 129 includes any type of foam, such as polyurethane, high density, closed cell, latex rubber, or high resilience foam, or any type of cushion material that provides a firm and resilient surface.

Figure 4:
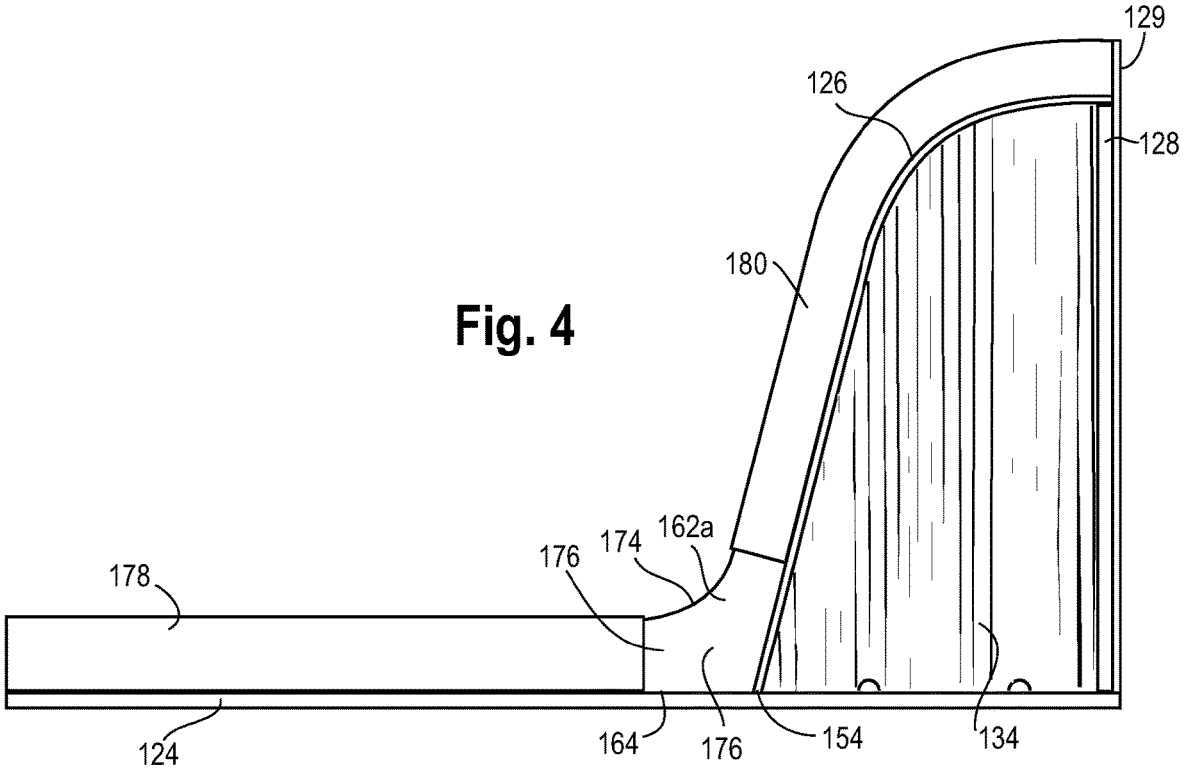
FIG. 4 shows a right end elevation view of the non-corner unit of FIG. 3 at an end portion of the non-corner unit.

FIG. 4 shows a side view of FIG. 3 including the non-corner furniture unit 104 with the first planar element 178, the second planar element 180, and one of the end contoured elements 162*a*. As shown in FIG. 4, the first planar element 178, the second planar element 180, and the end contoured elements 162*a* form a continuous surface such that no gap exists between these elements on the ends of the non-corner furniture unit 104.

Figure 5:
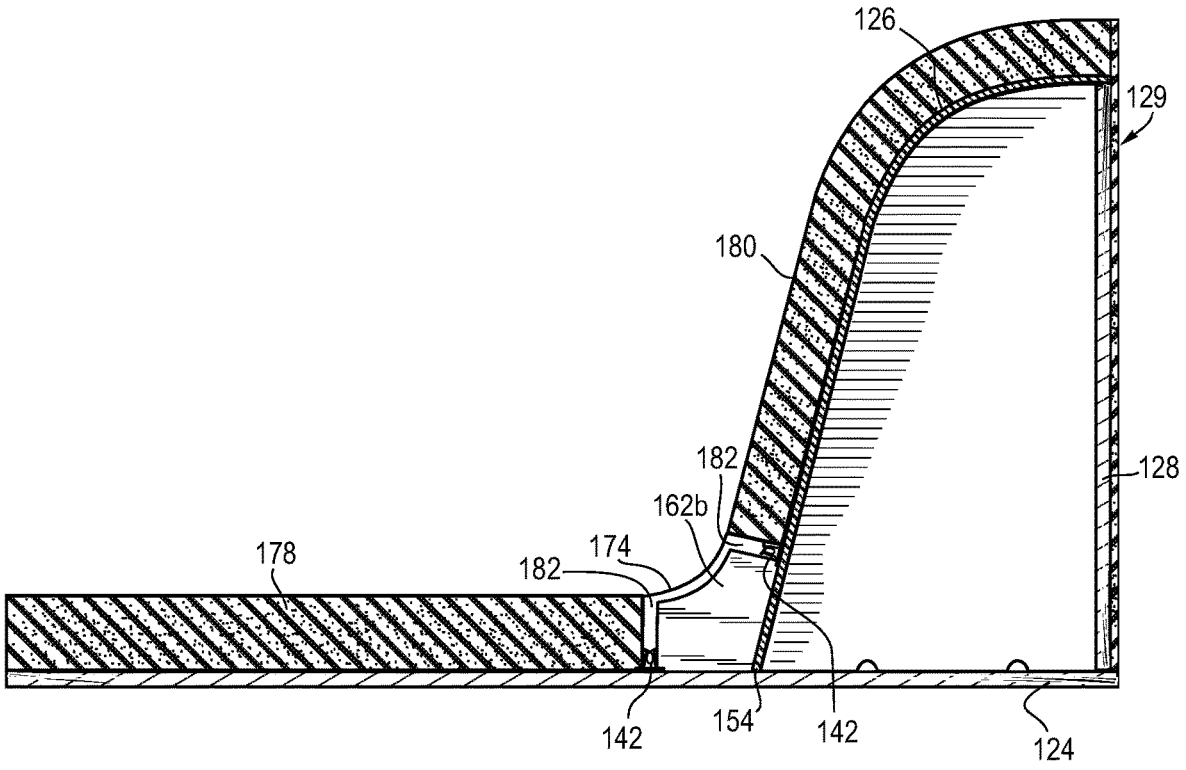
FIG. 5 shows a cross-sectional view of the non-corner unit of FIG. 3 taken along line 5-5 through a center portion of the non-corner unit.

FIG. 5 shows a cross-sectional view along the line 5-5 of FIG. 3 and shows one of the plurality of clips 142 positioned on the support surface 124 for seating and within the gap 182 between the first planar element 178 and one of the middle contoured elements 162*b*. FIG. 5 also shows one of the plurality of clips 142 positioned on the support surface 126 for back support and within the gap 182 between the second planar element 180 and one of the middle contoured elements 162*b*.

The upholstery system 141 also includes positioning at least one piece of fabric 184 on the first planar element 178, the second planar element 180, and the plurality of contoured elements 162. FIGS. 6-9C show the at least one piece of fabric 184. The at least one piece of fabric 184 may include one or more of a variety of fabrics including without limitation cotton, cotton blend, wool, silk, leather, linen, nylon, polyester, polypropylene, rayon, cotton blend, olefin, microfiber, vinyl, acetate, acrylic, or any other fabric used for furniture. The at least one piece of fabric 184 may include one or more pieces of fabric connected together via stitching, knitting, an adhesive and/or bonding, such as thermal bonding, or the at least one piece of fabric 184 may include one piece of fabric that is knitted or otherwise formed to include one or more sections. The embodiments herein are described as the at least one piece of fabric 184 including one or more pieces of fabric connected together via stitching, knitting, an adhesive and/or bonding, such as thermal bonding; however, one of skill in the art would understand how to apply the upholstery method and system described herein when using the at least one piece of fabric 184 that includes one piece of fabric that is knitted or otherwise formed to include one or more sections. Knitting as used herein includes any form of knitting known in the art, including weft and warp knitting and flat and circular knitting. An adhesive as used herein includes any form of adhesive known in the art, including a fabric adhesive, glue, epoxy, polyurethane, pressure sensitive adhesive, spray adhesive, or cyanoacrylate adhesive.

Figure 6:
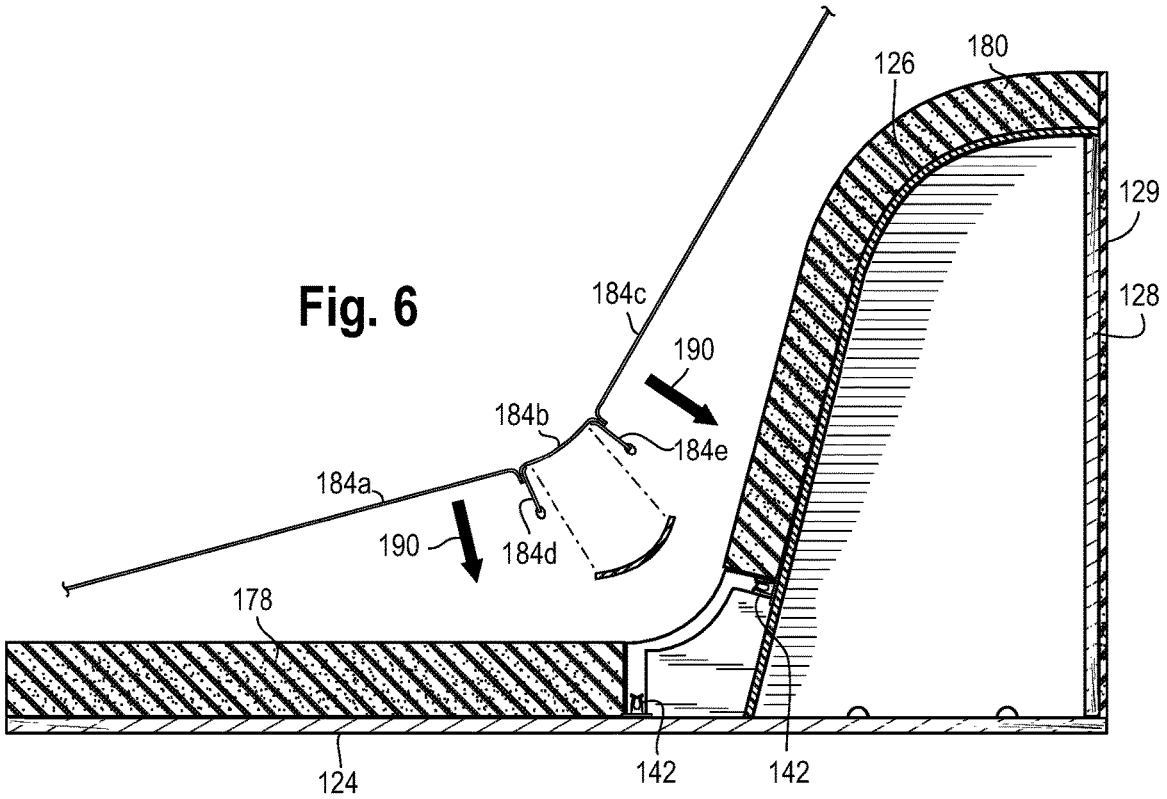
FIG. 6 shows a cross-sectional view of the non-corner unit of FIG. 5 including a contoured structural element and at least one piece of fabric oriented for placement and connection thereupon.
Figure 7:
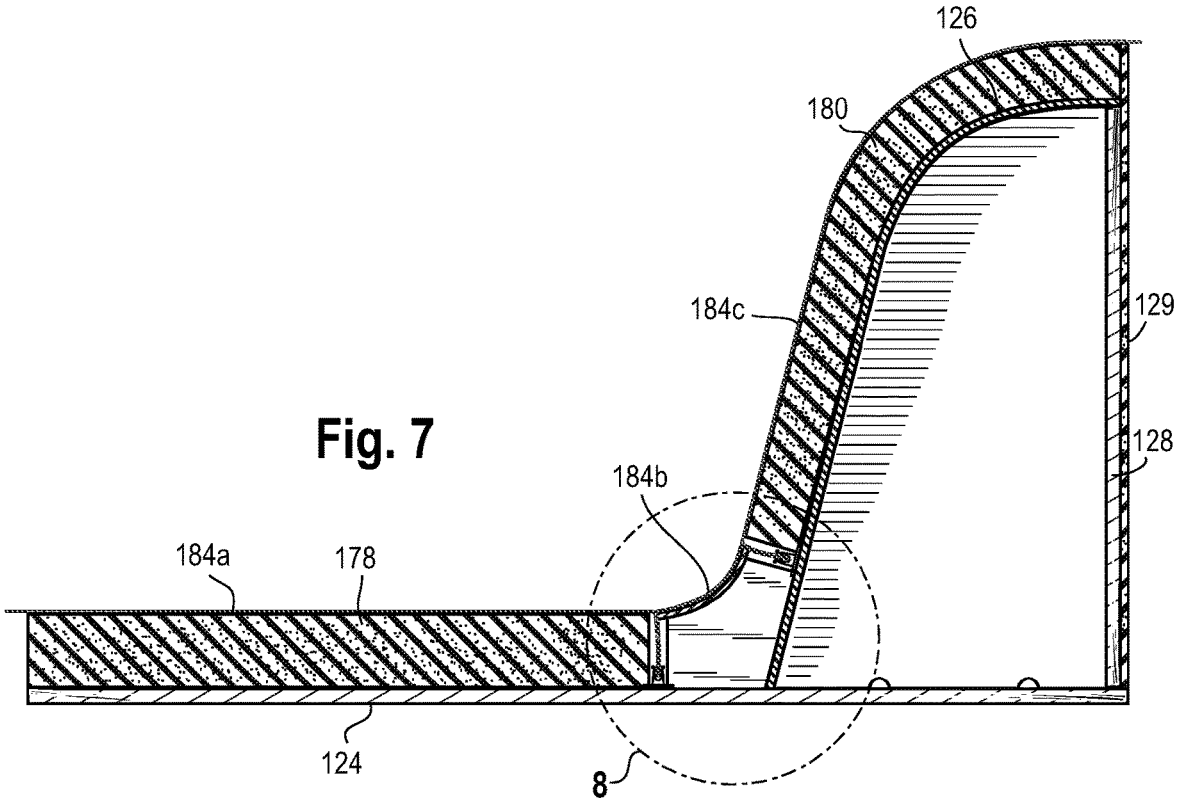
FIG. 7 shows a cross-sectional view of the non-corner unit of FIG. 6 including the contoured structural element and at least one piece of fabric connected to a plurality of clips.

In one embodiment, the at least one piece of fabric 184 may include at least three sections, and in a second embodiment, the at least one piece of fabric 184 may include at least five sections. In both embodiments, as shown in FIGS. 6-9C, a first section 184*a*, a second section 184*b*, and a third section 184*c* of the at least one piece of fabric 184 are connected in series such that adjacent sections form a connected portion 186. The first section 184*a* covers the first planar element 178, the second section 184*b* covers the plurality of contoured elements 162, and the third section 184*c* covers the second planar element 180, as shown in FIGS. 7-8.

Where adjacent sections of the first, second, and third sections 184*a*, 184*b*, 184*c* meet, their adjacent edges are folded down or down and under such that a portion of each of the first, second and third sections 184*a*, 184*b*, 184*c* extend in the direction of the arrows 190 of FIG. 6 or extend in the direction of the arrows 190 and then underneath their own respective section (not shown). The connected portion 186 includes the portions of adjacent sections that extend down in the direction of the arrows 190, wherein these portions of adjacent sections are connected via stitching, knitting, an adhesive and/or bonding, such as thermal bonding, and/or the connection portion 186 includes the location where adjacent sections meet prior to being folded underneath its respective section, wherein the adjacent sections are connected via an adhesive. The folding down or down and under of the adjacent edges of the first, second, and third sections 184*a*, 184*b*, 184*c* forms a continuous surface In the first embodiment including the at least three sections, the connected portion 186 of adjacent sections of the first, second, and third sections 184*a*, 184*b*, 184*c* is connected to the plurality of clips 142 via a bar 188 that is inserted into the plurality of clips 142. The connected portion 186 of adjacent sections are attached to the bar 188 via any form of adhesive, mechanical connection such as a snap-in or snug-fit, or other connection known in the art to connect two elements together.

In the second embodiment, as shown in FIGS. 6-9C, the at least one piece of fabric 184 also includes a fourth section 184*d* and a fifth section 184*e*. In this second embodiment, the fourth section 184*d* is connected to the second section 182*b* via stitching, knitting, an adhesive and/or bonding, such as thermal bonding, and adjacent to the connected portion 186 between the first section 184*a* and the second section 182*b*. The fourth section 184*d* extends from the second section 182*b* toward the plurality of clips 142 positioned on the support surface 124 for seating, and the fourth section 184*d* is connected to the plurality of clips 142 via the bar 188. The fourth section 184*d* is attached to the bar 188 via any form of adhesive, mechanical connection such as a snap-in or snug-fit, or other connection known in the art to connect two elements together. The fifth section 184*e* is connected to the second section 182*b* via stitching, knitting, an adhesive and/or bonding, such as thermal bonding, and adjacent to the connected portion 186 between the second section 184*b* and the third section 184*c*. The fifth section 184*e* extends from the second section 182*b* toward the plurality of clips 142 positioned on the support surface 126 for back support, and the fifth section 184*e* is connected to the plurality of clips 142 via the bar 188. The fifth section 184*e* is attached to the bar 188 via any form of adhesive, mechanical connection such as a snap-in or snug-fit, or other connection known in the art to connect two elements together.

The upholstery system 141 also includes a contoured structural element 192 that is positioned under the second section 184*b* of the at least one piece of fabric 184, as shown in FIG. 6. The contoured structural element 192 is connected to the second section 184*b* via an adhesive. The contoured structural element 192 is positioned under the second section 184*b* such that the connected portion 186 of the first, second, and third sections 184*a*, 184*b*, and 184*c* and/or the fourth and fifth sections 184*d*, 184*e* of the at least one piece of fabric extend around the contoured structural element 192 to connect to the plurality of clips 142. The contoured structural element 192 includes a curved and concave shape to be positioned over the fifth and curved surface 174 of each of the plurality of contoured elements 162. With the second section 184*b* of the at least one piece of fabric 184 adhesively connected to the contoured structural element 192, the at least one piece of fabric 184 forms a continuous and smooth concave surface for seating. Specifically, the at least one piece of fabric extends continuously along and over the first planar element 178, the plurality of contoured elements 162, and the second planar element 180, as shown in FIGS. 7-8. The material of the contoured structural element 192 includes a thermoplastic, a plastic, or other material capable of being molded to a curved shape. The contoured structural element 192 also extends across each of the plurality of contoured elements 162 and from one opposing edge 150 of the support surface to the second opposing edge 150 of the support surface 124 for seating.

Figure 9A:
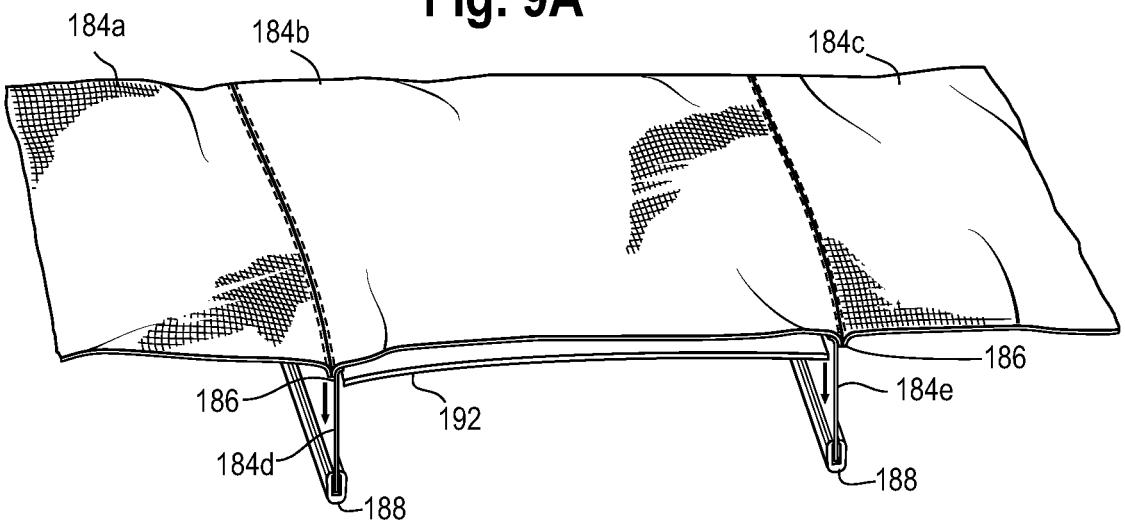
FIG. 9A shows a perspective view of the contoured structural element and the at least one piece of fabric of FIG. 6.
Figure 9B:
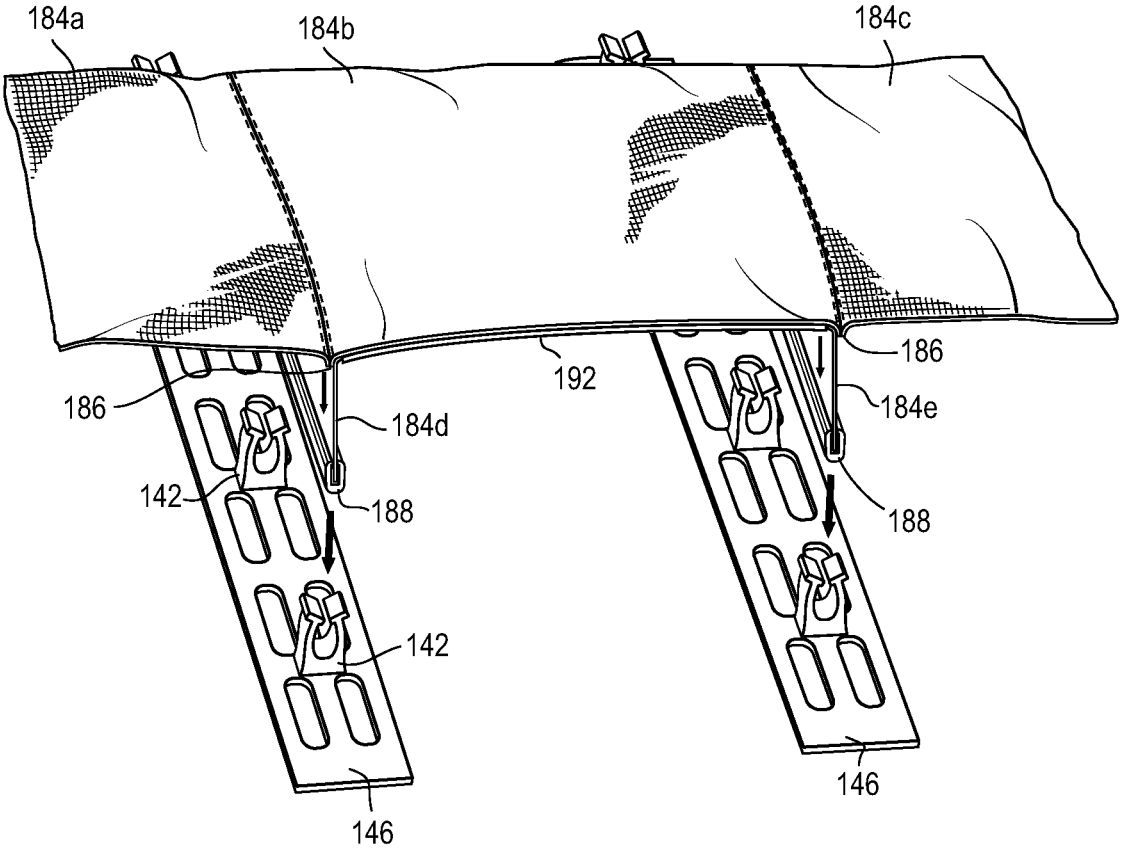
FIG. 9B shows a perspective view of the contoured structural element and the at least one piece of fabric of FIG. 6 positioned over the plurality of clips for connection thereto.
Figure 9C:
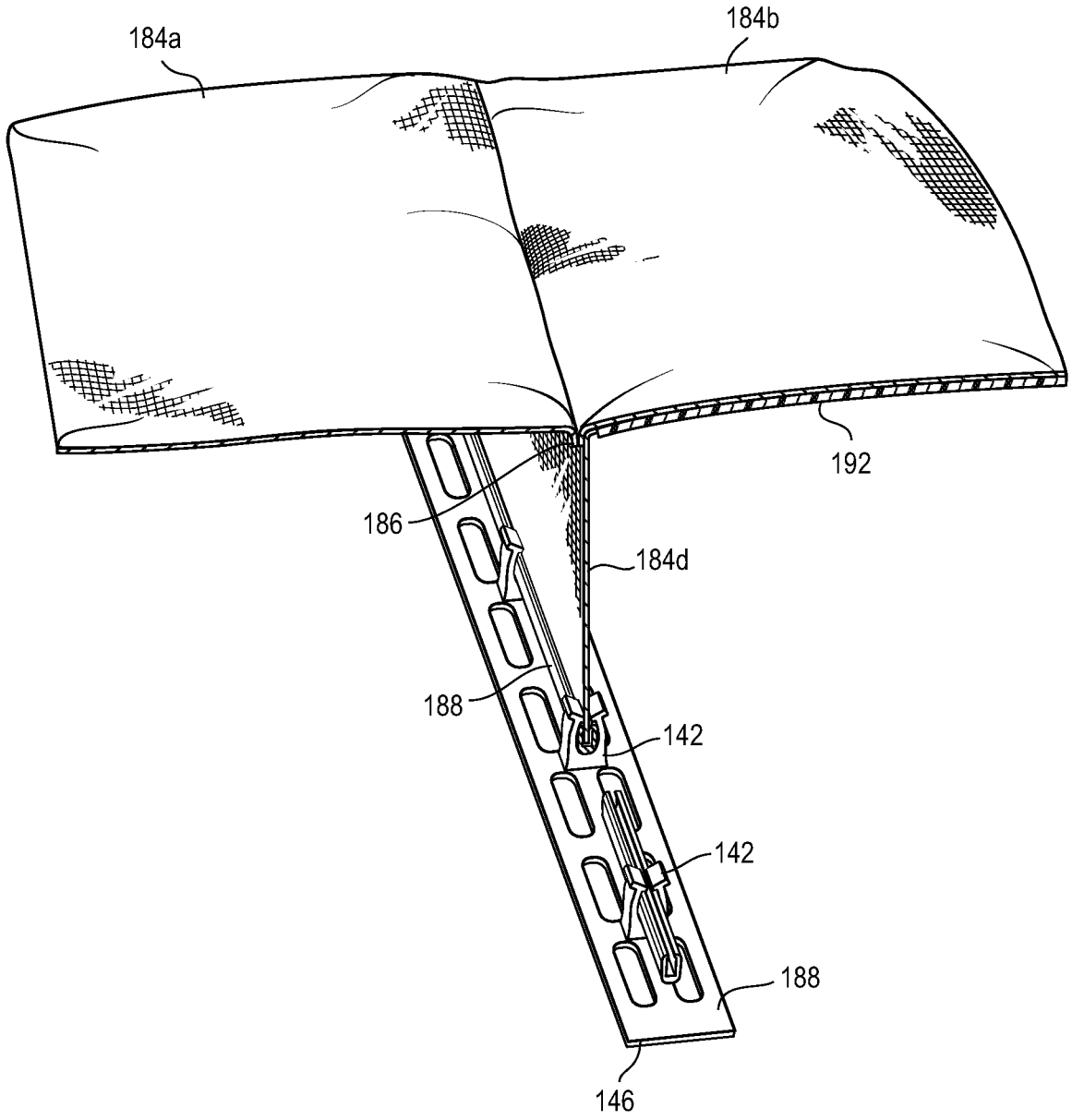
FIG. 9C shows a perspective view of the contoured structural element and the at least one piece of fabric of FIG. 6 connected to the plurality of clips.

FIG. 6, as described above, shows a cross-sectional view of the positioning of the first, second, third, fourth, and fifth sections 184*a*, 184*b*, 184*c*, 184*d*, 184*e* of the at least one piece of fabric 184, the bars 188, and the contoured structural element 192 over the non-corner furniture unit 104. FIG. 7 shows a cross-sectional view of the at least one piece of fabric 184 connected to the plurality of clips 142 via the bars 188. FIG. 8 shows a detailed call-out view taken of the region identified by line 8 of FIG. 7 including the at least one piece of fabric 184 connected to the plurality of clips 142 via the bars 188. FIGS. 9A-9C show perspective views of the contoured structural element 192 and the at least one piece of fabric 184 connected to the bars 188, the contoured structural element 192 connected to the at least one piece of fabric 184 and positioned over the plurality of clips 142, and the at least one piece of fabric 184 connected to the plurality of clips 142 via the bar 188, respectively.

Upholstery Method and System—Corner Furniture Unit

Figure 10:
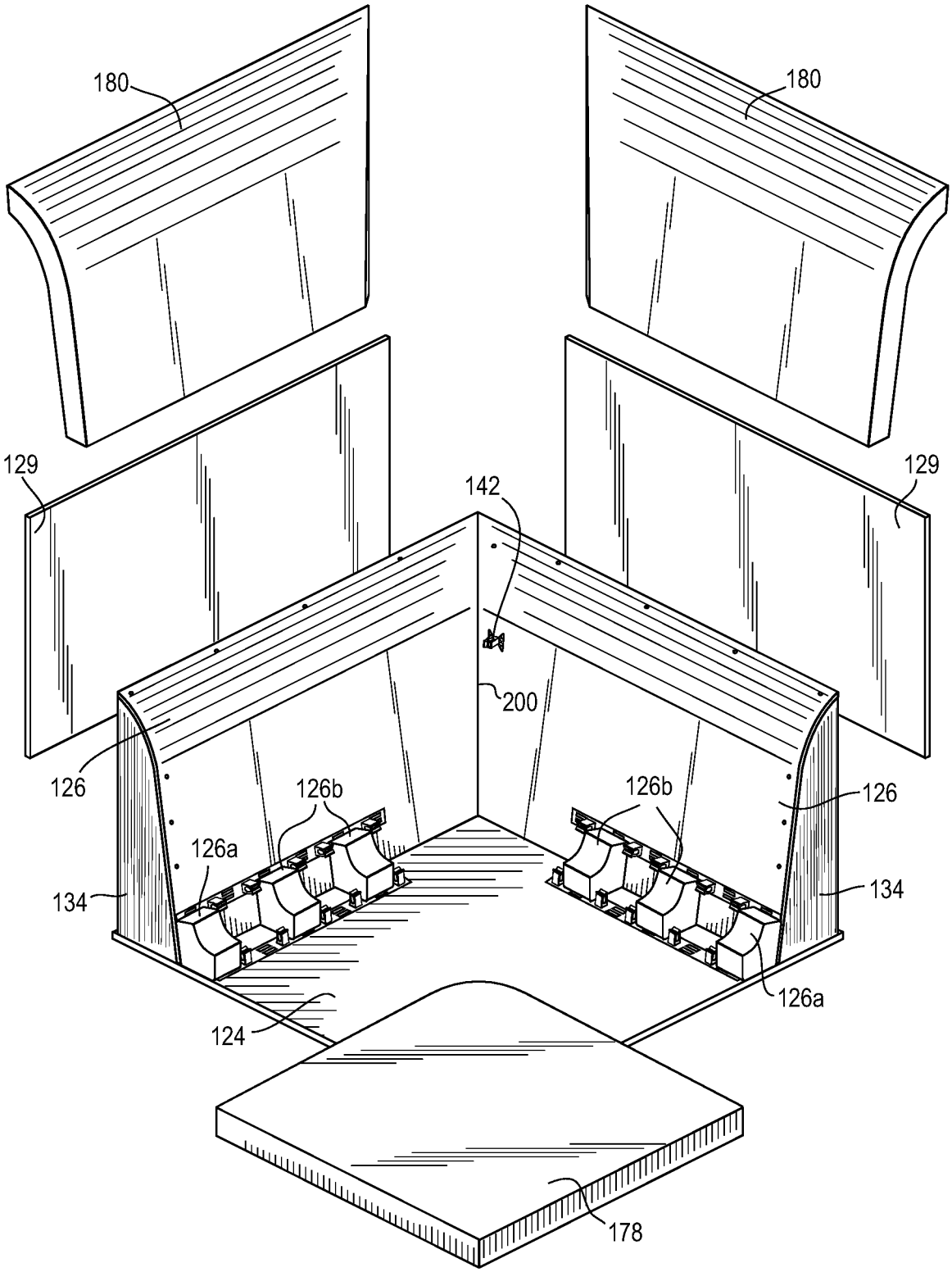
FIG. 10 shows an exploded perspective view of an embodiment of a corner unit of modular unit incorporating an embodiment of a upholstery system for forming a curved surface.

The upholstery system 141 described above for the non-corner furniture unit 104 may also be used for other types of furniture to form a concave surface. For example, FIG. 10 shows a corner furniture unit 106 of the modular furniture system 100. The descriptions of the elements of the upholstery system 141 described above regarding the non-corner furniture unit 104 that are also used for the corner furniture unit 106 are not repeated here and the following description provides the differences between the upholstery system 141 for the non-corner unit 104 and the corner unit 106.

As compared to the non-corner furniture unit 104, the corner furniture unit 106 includes two support surfaces 126 for back support and also includes two corresponding back panels 128, two second planar elements 180, and two additional planar elements 129. As shown in FIG. 10, the plurality of contoured elements 162 are positioned on the support surface 124 for seating and along the corner 154 where the support surface 124 for seating meets one of the support surfaces 126 for back support and also along the corner 154 where the support surface 124 for seating meets the other of the support surfaces 126 for back support. The plurality of clips 142 positioned near the plurality of contoured elements 162 are positioned in the same manner as described above regarding the non-corner furniture unit 104. As compared to the non-corner furniture unit 104, the corner furniture unit 106 includes at least one clip of the plurality of clips 142 along at least one of the two support surfaces 126 for back support, as shown in FIG. 10, to allow the at least one piece of fabric 184 to be pulled and/or tucked into the corner 200 where the two support surfaces 126 meet.

Figure 11:
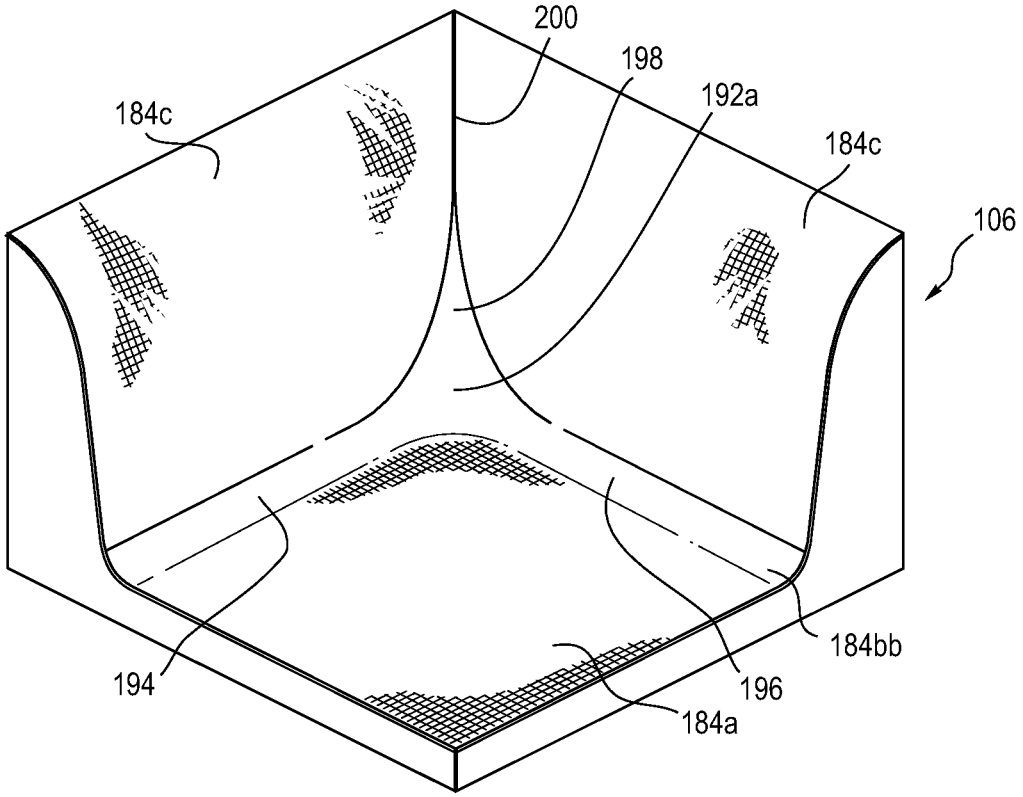
FIG. 11 shows a perspective view of the corner unit of FIG. 10 incorporating the upholstery system for forming a curved surface.

The corner furniture unit 106 also includes a different embodiment of the contoured structural element. FIG. 11 shows the corner furniture unit 106 after the at least one piece of fabric 184 has been connected to the plurality of clips 142 via the bars 188. FIG. 11 shows the outline of the shape of the contoured structural element 192*a* for the corner furniture unit 106. The contoured structural element 192*a* includes a first section 194 that has a curved and concave-shape and that extends along the horizontal plane 130 over the plurality of contoured elements 162 positioned between the support surface 124 for seating and one of the two support surfaces 126 for back support. The contoured structural element 192*a* also includes a second section 196 that has a curved and concave-shape, is connected to or integral with the first section 194, and extends along the z-plane 144 over the plurality of contoured elements 162 positioned between the support surface 124 for seating and the second of the two support surfaces 126 for back support. The contoured structural element 192*a* also includes a third section 198 that is connected to or integral with the first and second sections 194, 196 and extends along the vertical plane 132 and along the corner 200 where the two support surfaces 126 for back support meet. The third section 198 has a curved and concave-shape that tapers as it extends along the vertical plane 132 and along the corner 200, as shown in FIG. 11. The material of the contoured structural element 192*a* for the corner furniture unit 106 is the same as the material of the contoured structural element 192 for the non-corner furniture unit 104.

As compared to the non-corner furniture unit 104, the at least one piece of fabric 184 of the corner furniture unit 106 includes additional sections to accommodate the shape of the corner furniture unit 106. The at least one piece of fabric 184 is connected to the plurality of clips 142 using the same system as described above for the non-corner furniture unit 104. In addition to the first section 184*a* of the at least one piece of fabric 184, the at least one piece of fabric 184 of the corner furniture unit 106 includes two third sections 184*c*, wherein one of the third sections 184*c* is positioned over one of the second planar elements 180 and the other of the third sections 184*c* is positioned over the other of the second planar elements 180.

The second section 184*bb* of the at least one piece of fabric 184 also has the same shape as the shape of the contoured structural element 192*a* for the corner unit rather than the shape of the contoured structural element 192 for the non-corner unit. In view of the shape of the second section 184*bb* and the shape of the contoured structural element 192*a*, the second section 184*bb* connects to one of the third sections 184*c* along both the horizontal plane 130 and along the vertical plane 132, and the second section 184*bb* connects to the other of the third sections 184*c* along both the z-plane 144 and along the vertical plane 132. The at least one piece of fabric 184 that extends along the third section of the contoured structural element 192*a* along the vertical plane 132 is connected to the at least one clip of the plurality of clips 142 that is positioned on one of the support surfaces 126 for back support via the bar 188. Additional clips of the plurality of clips 142 may be positioned on the support surfaces 126 for back support to tuck and/or pull the at least one piece of fabric 184 adjacent to the contoured structural element 192.

Upholstery Method and System—Left and Right End Furniture Units

Figure 13:
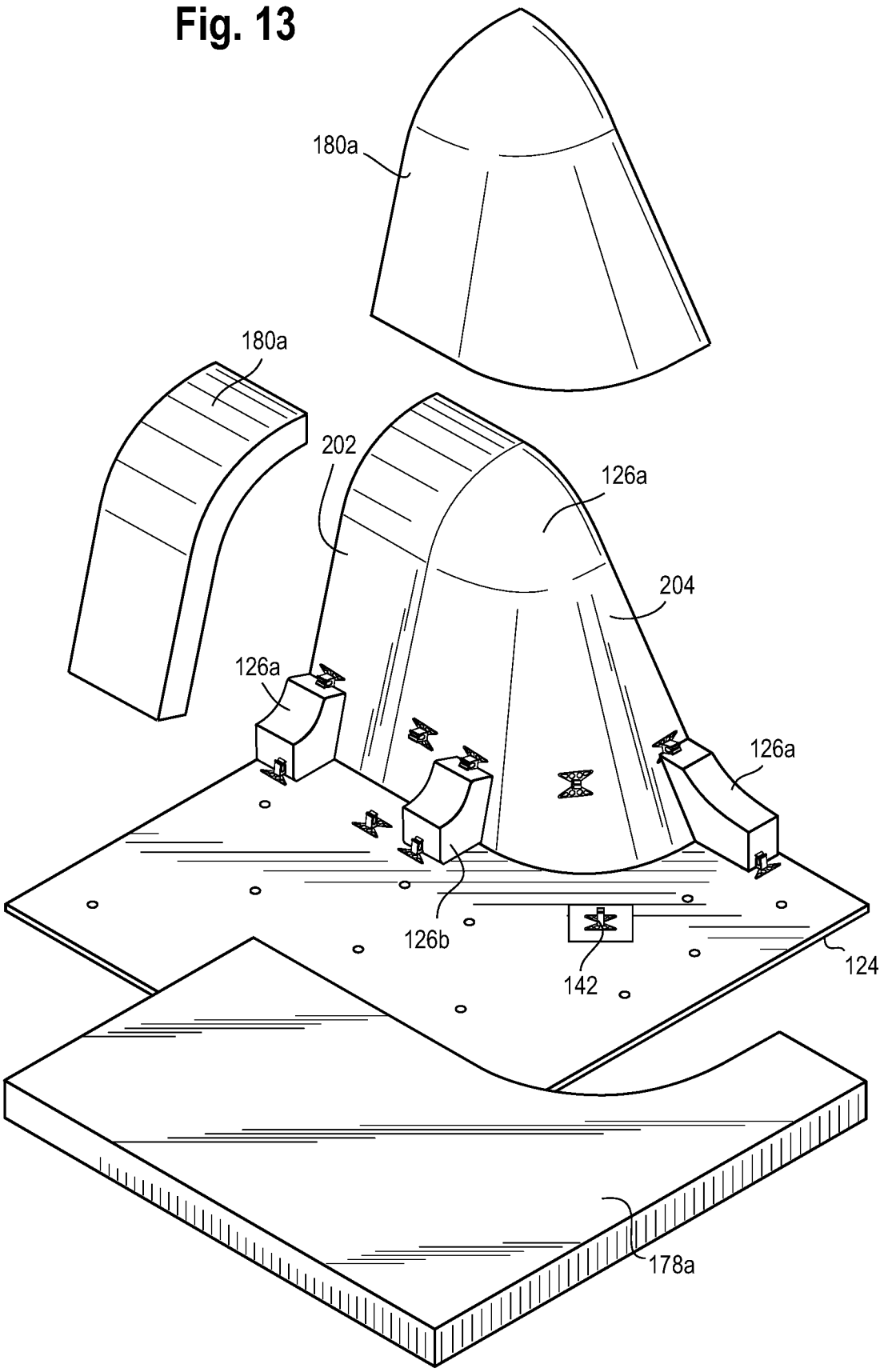
FIG. 13 shows an exploded perspective view of an embodiment of a left end unit of modular unit incorporating an embodiment of a upholstery system for forming a curved surface.
Figure 14:
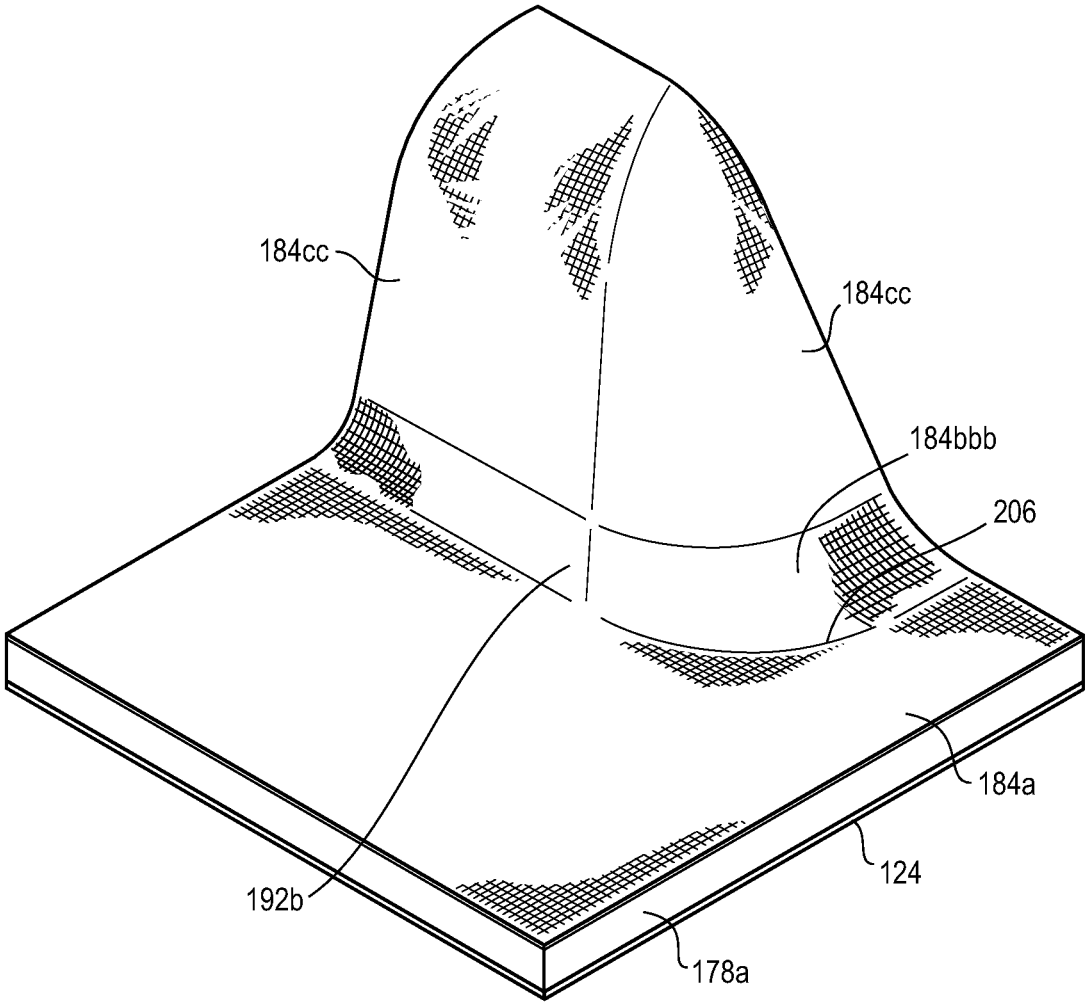
FIG. 14 shows a perspective view of the left end unit of FIG. 13 incorporating the upholstery system for forming a curved surface.
Figure 15:
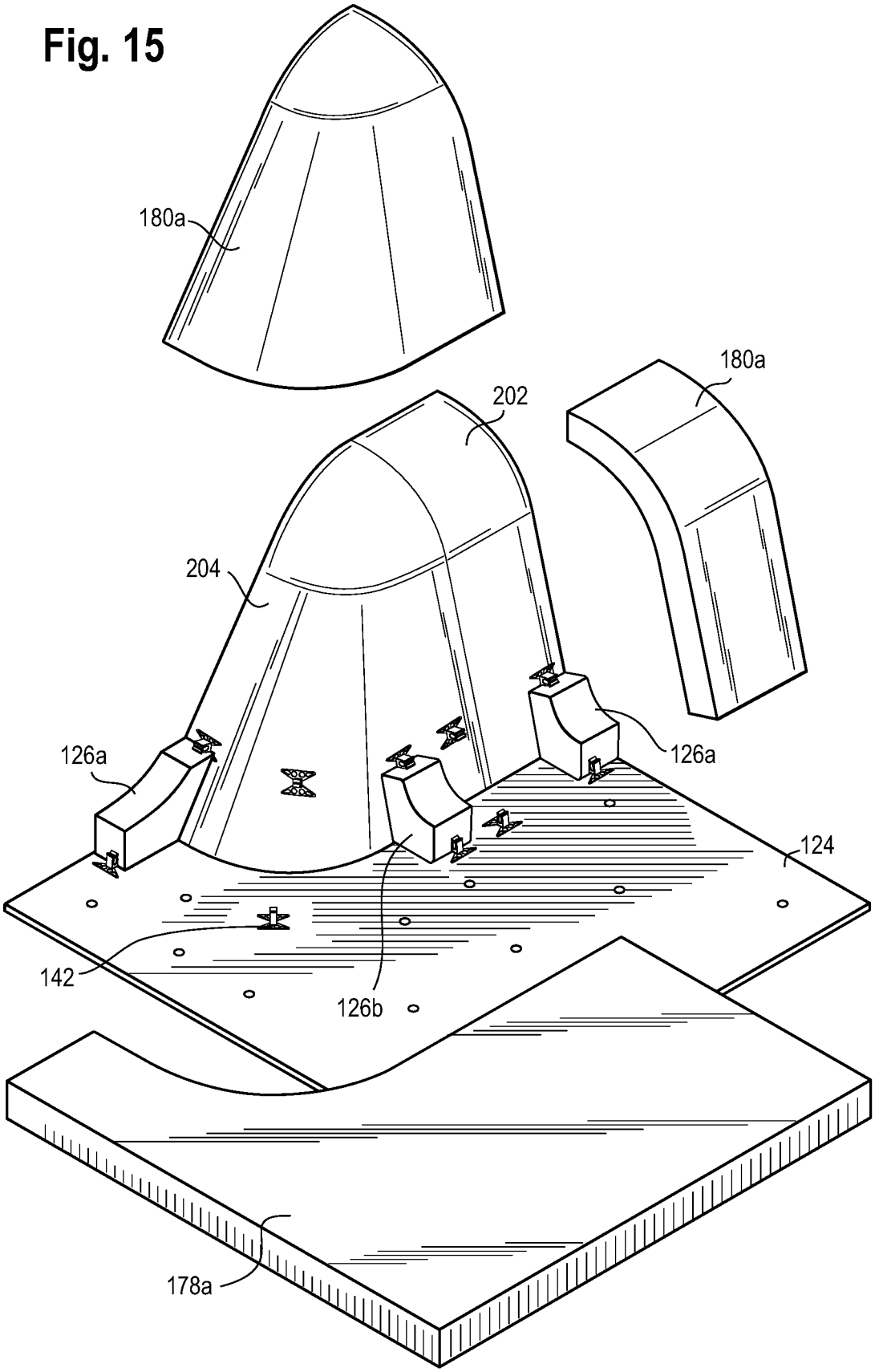
FIG. 15 shows an exploded perspective view of an embodiment of a right end unit of modular unit incorporating an embodiment of a upholstery system for forming a curved surface.
Figure 16:
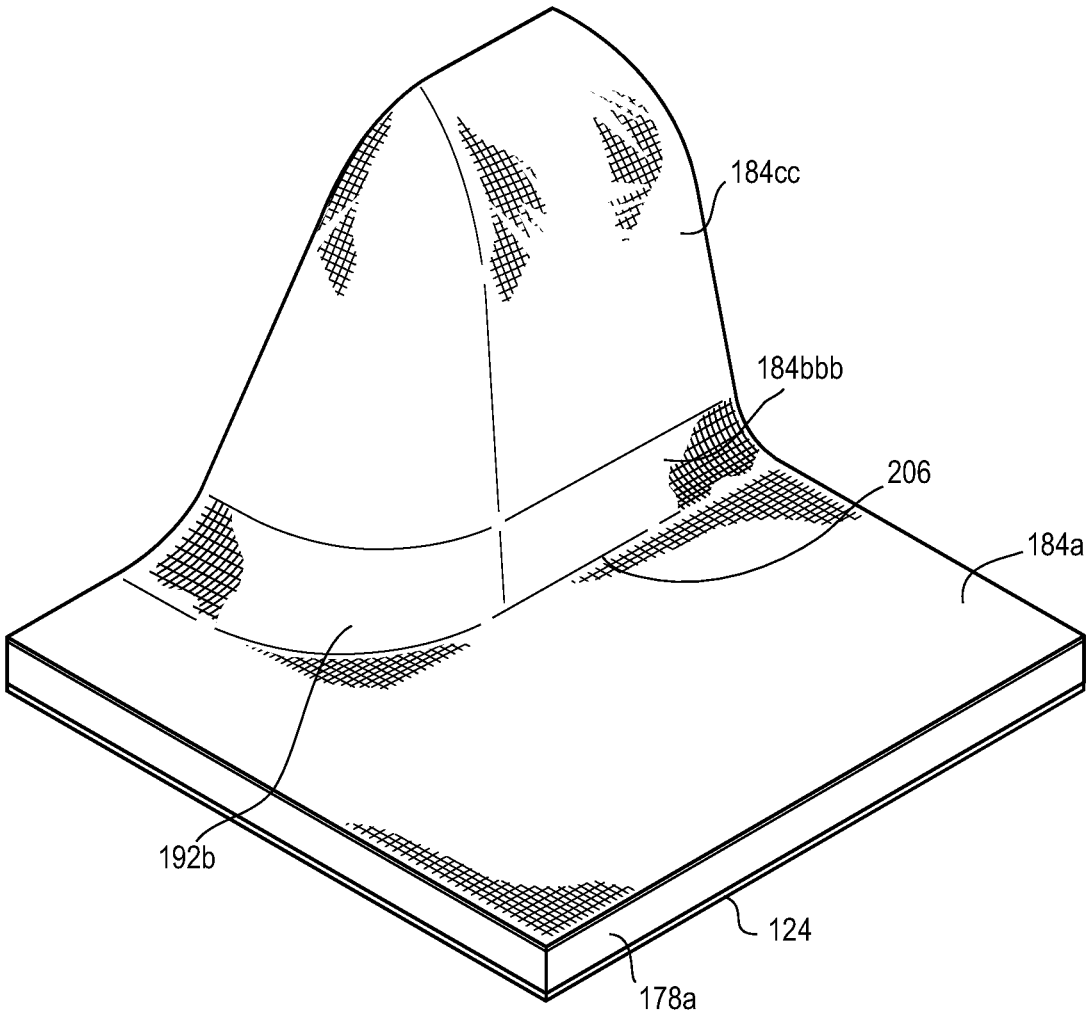
FIG. 16 shows a perspective view of the right end unit of FIG. 15 incorporating the upholstery system for forming a curved surface.

FIGS. 13-14 show an embodiment of a left end furniture unit 108 of the modular furniture system 100. FIGS. 15-16 show an embodiment of a right end furniture unit 110 of the modular furniture system 100. The upholstery system 141 described above for the non-corner furniture unit 104 may also be used to form a concave surface on the left end furniture unit 108 and the right end furniture unit 110. The descriptions of the elements of the upholstery system 141 described above regarding the non-corner furniture unit 104 that are also used for the left end furniture unit 108 and the right end furniture unit 110 are not repeated here and the following description provides the differences between the upholstery system 141 for the non-corner unit 104 and the left and right end furniture units 108, 110.

As compared to the non-corner unit 104, the support surface 126*a* for back support of the left end furniture unit 108 has a different shape than the support surface 126 for back support of the non-corner unit 104. As shown in FIG. 13, the support surface 126*a* for back support includes a first section 202 that is similar to the shape of the support surface 126 for back support of the non-corner unit 104 and a second section 204 that extends from the first section 202 and forms a curved and contoured shape.

As shown in FIG. 13, the plurality of contoured elements 162 are positioned along the corner 154 where the support surface 126*a* for back support and the support surface 124 for seating meet. In this embodiment, the angle 168 between the first surface 164 and the second surface 166 of the plurality of contoured elements 162 that are positioned around the second section 204 of the support surface 126*a* for back support is greater than the angle 168 between the first and second surfaces 164, 166 of the plurality of contoured elements 162 that are positioned along the first section 202 of the support surface 126*a* for back support.

The first planar element 178*a* of the left end furniture unit 108 is positioned on the support surface 124 for seating and includes a cutout that conforms to the shape of support surface 126*a* for back support that is adjacent to the support surface 124 for seating. The second planar element 180*a* of the left end furniture unit 108 is positioned on the support surface 126*a* for back support and includes two sections. The first section of the second planar element 180*a* is positioned on the first section 202 of the support surface 126*a*, and the second section of the second planar element 180*a* is positioned on the second section 204 of the support surface 126*a*. The plurality of clips 142 are positioned, as described previously for the non-corner unit, on the support surface 124 for seating between the first planar element 178*a* and the fourth surface 172 of the plurality of contoured elements 162 and also on the support surface 126*a* for back support between the second planar element 180*a* and the third surface 170 of the plurality of contoured elements 162.

The left end furniture unit 108 also includes a different embodiment of the contoured structural element 192*b*. FIG. 14 shows the left end furniture unit 108 after the at least one piece of fabric 184 has been connected to the plurality of clips 142 via the bars 188. FIG. 14 shows the outline of the shape of the contoured structural element 192*b* for the left end furniture unit 108. The contoured structural element 192*b* extends around the support surface 126*a* of the left end furniture unit 108 and is positioned over the fifth and curved surface of each of the plurality of contoured elements 162. The contoured structural element 192*b* includes a curved and concave surface that has the same shape as the fifth surface 174 of each of the plurality of contoured elements 162.

The sections of the at least one piece of fabric 184 for the left end furniture unit 108 have a different shape than the sections of the at least one piece of fabric 184 for the non-corner furniture unit 104 to accommodate the different shape of the left end furniture unit 108 as compared to the non-corner furniture unit 104. For example, as shown in FIGS. 9A-9B, the first section 184*a* of the at least one piece of fabric 184 for the non-corner furniture unit 104 is generally square shaped to be positioned over the first planar element 178 of the non-corner furniture unit 104. For the left-end furniture unit 108, as shown in FIG. 14, the first section 184*a* of the at least one piece of fabric 184 includes a cutout 206 to accommodate the shape of the support surface 126*a* for back support for the left end furniture unit 108. Also, the second section 184*bbb* of the at least one piece of fabric 184 for the left end furniture unit 108 includes the same shape as the shape of the contoured structural element 192*b* of the left end furniture unit 108 to be positioned over the contoured structural element 192*b*. Also, the third section 184*cc* of the at least one piece of fabric 184 for the left end furniture unit 108 includes the same shape as the shape of the support surface 126*a* for back support such that the third section 184*cc* may be positioned over the support surface 126*a* for back support.

The right end furniture unit 110 of the modular furniture system 100, as shown in FIGS. 15-16, has a shape that mirrors that the shape of the left end furniture unit 108. The description above regarding the upholstery method for the left end furniture unit 108 also applies to the right end furniture unit 110.

Upholstery Method and System—Chair

Figure 17:
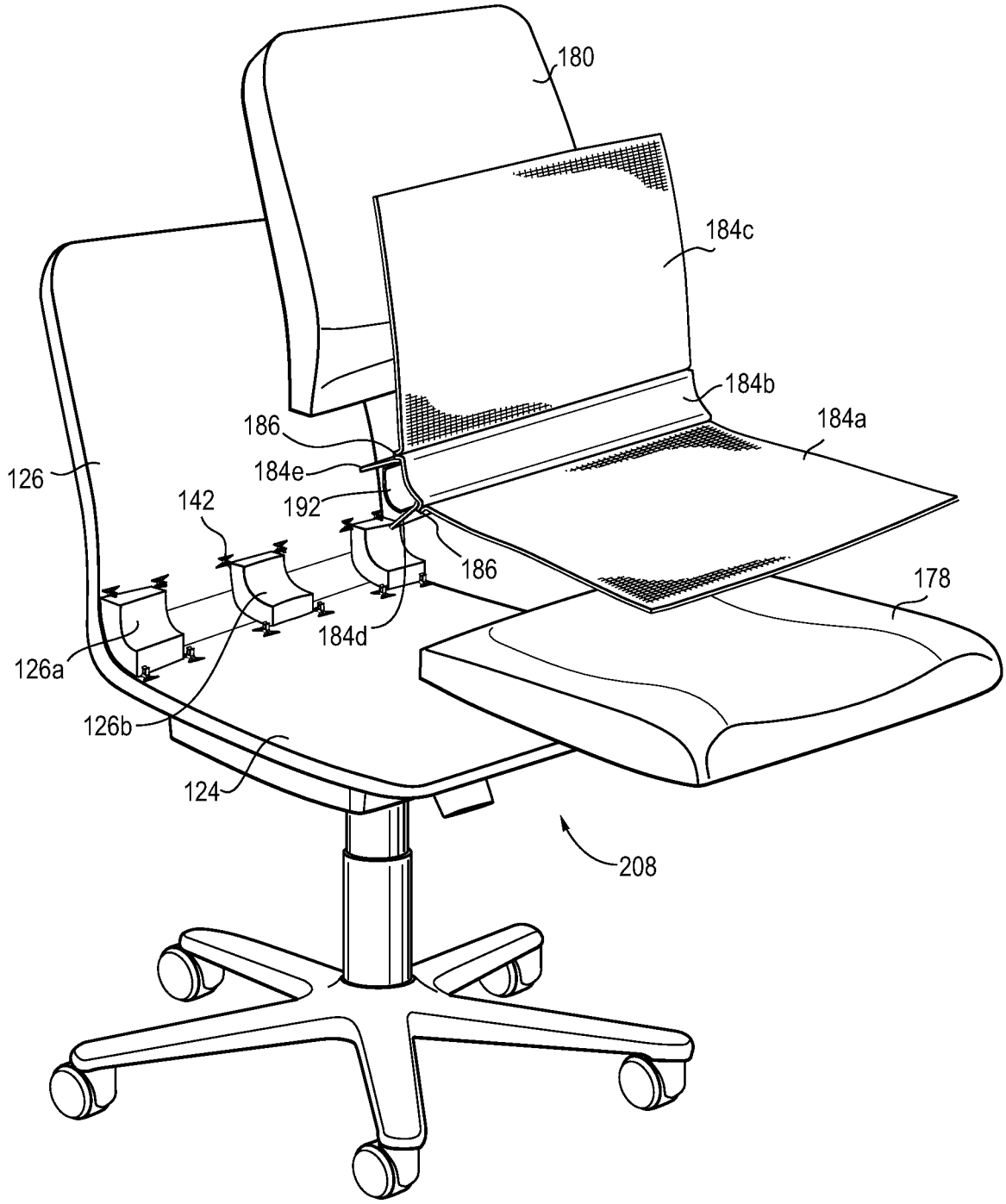
FIG. 17 shows an exploded perspective view of an embodiment of a chair incorporating an embodiment of a upholstery system for forming a curved surface.

FIG. 17 shows an embodiment of the upholstery method and system 141 being applied to another type of furniture including an embodiment of chair 208. The upholstery method and system 141 described above for a non-corner furniture unit 104 also applies to the chair 208, and the descriptions of the elements of the upholstery system 141 described above regarding the non-corner furniture unit 104 that are also used for the chair 208 are not repeated here. FIG. 17 provides an example of another type of furniture that the upholstery system 141 described above for the non-corner furniture unit 104 may be used to form a concave surface during an upholstery application. One of skill in the art would understand that the upholstery method and system can be used on a variety of furniture, including without limitation task chairs, conference chairs, lounge seating, and other forms of seated surfaces.

Upholstery Method and System—Furniture Screen

Figure 18:
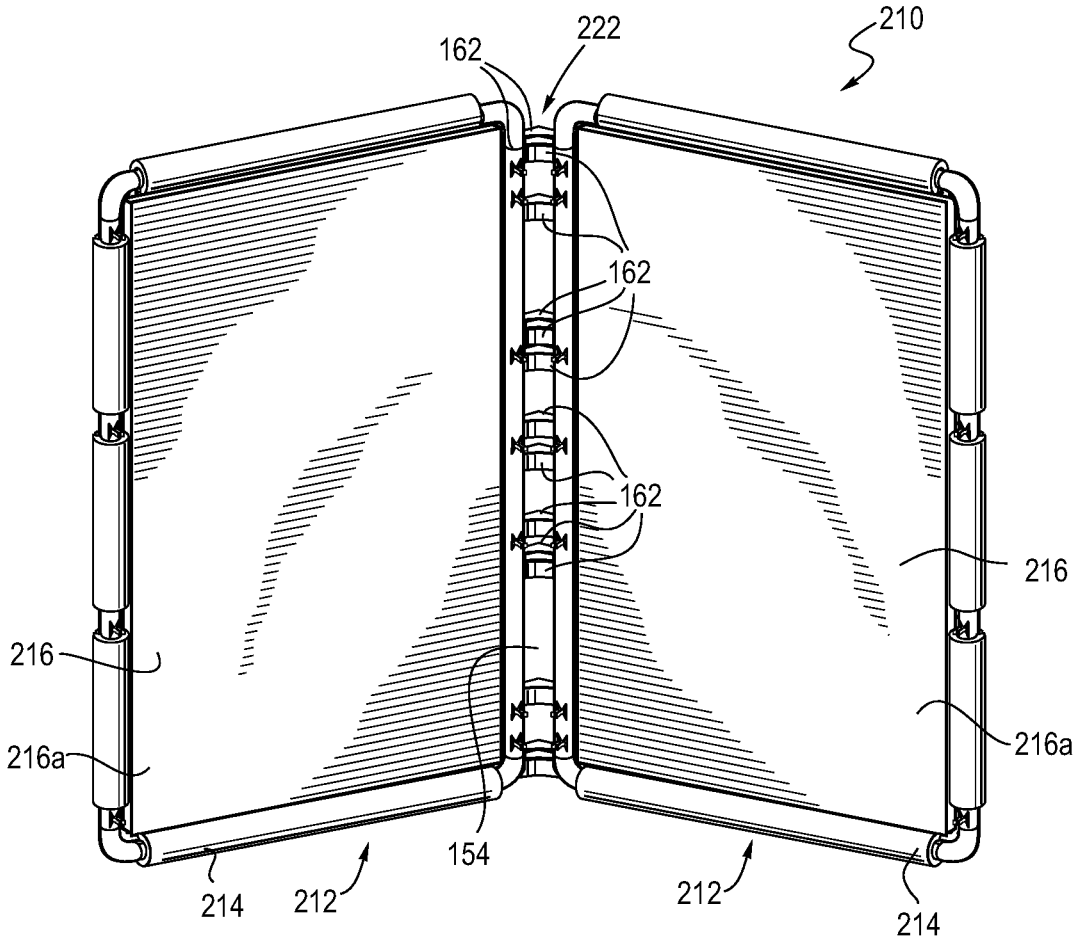
FIG. 18 shows a perspective view of an embodiment of a furniture screen.

FIG. 18 shows an embodiment of a furniture screen 210 that includes at least two screens 212. Each of the two screens 212 includes a frame 214 and a panel 216 positioned within the frame 214. The two screens 212, the frames 214 and the panels 216 each have a generally square shape. The two screens 212 are connected to each along adjacent edges, as shown in FIG. 18. An embodiment of a connector for adjacent furniture screens is also described below in more detail.

Figure 19:
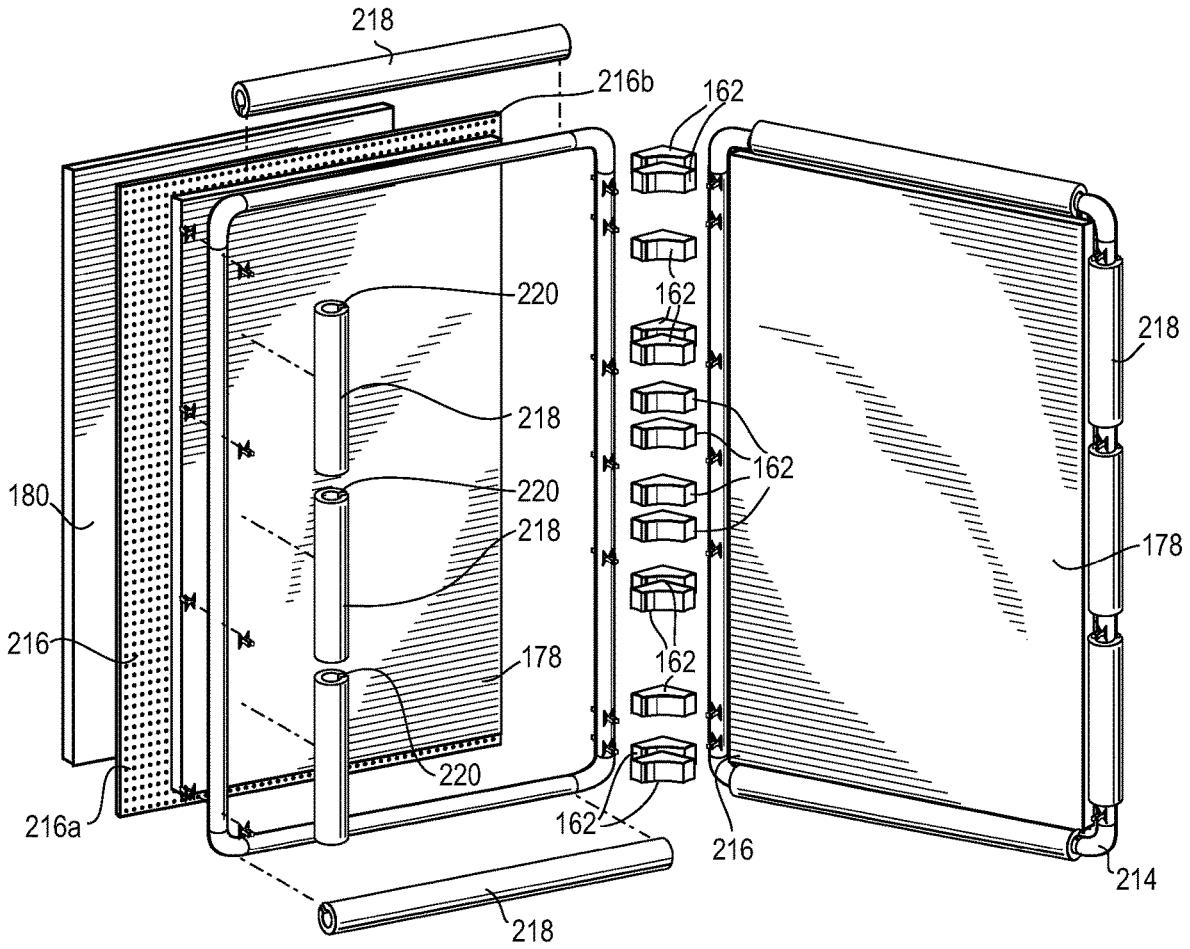
FIG. 19 shows an exploded perspective view of the furniture screen of FIG. 18 incorporating an embodiment of a upholstery system for forming a curved surface.

FIG. 19 shows an embodiment of the upholstery method and system 141 being applied to the furniture screen 210. The upholstery system 141 described above for the non-corner furniture unit 104 may also be used to apply upholstery to a curved surface and form a curved surface on the furniture screen 210. The descriptions of the elements of the upholstery system 141 described above regarding the non-corner furniture unit 104 that are also used for the furniture screen 210 are not repeated here and the following description provides the differences between the upholstery system 141 for the non-corner unit 104 and the furniture screen 210.

As compared to the non-corner furniture unit 104, the upholstery system 141 for the furniture screen 210 may also include a plurality of circular elements 218. The material for the plurality of circular elements 218 may be the same as the material for the at least two planar elements 178, 180, which includes any type of foam, such as polyurethane, high density, closed cell, latex rubber, or high resilience foam, or any type of cushion material that provides a firm and resilient surface. Each of the plurality of circular elements 218 includes a circular cross section and a cutout 220 along its length to allow the plurality of circular elements 218 to be wrapped around and positioned on the frame 214 of each of the at least two screens 212, as shown in FIG. 19. The length of the plurality of circular elements 218 may vary to accommodate the dimensions of the frame 214.

The at least two screens 212 are positioned adjacent to each other and may be connected along their adjacent edges to form a corner where the two screens 212 meet. Where the two screens 212 meet, there is an inner or interior corner and an opposite outer or exterior corner. The inner or interior corner is the same as the corner 154 for the non-corner unit 104, and the inner or interior corner is also numbered as 154. The plurality of contoured elements 162 are positioned along the interior corner 154 in the same manner as described above for the non-corner furniture unit 104. The plurality of contoured elements 162 are also positioned along the exterior corner 222 and are oriented such that the fifth and curved surface 174 of the plurality of contoured elements 162 wrap around the frame 214 of each of the at least two screens 212, as shown in FIG. 19. While the plurality of contoured elements 162 are positioned along the interior corner 154 and the exterior corner 222, the plurality of circular elements 218 are positioned along the remaining portions of the frames 214 of the at least two screens 212.

Similar to the non-corner furniture 104, the first planar element 178 is positioned over the panel 216 of one of the at least two screens 212 on the interior side 216*a* of the panel 216, and the second planar element 180 is positioned over the panel 216 of the other of the at least two screens 212 on the interior side 216*a* of the panel 216. For the exterior side of the furniture screen 210, the first planar element 178 may also be positioned over the panel 216 of one of the at least two screens 212 on the exterior side 216*b* of the panel 216, and the second planar element 180 may be positioned over the panel 216 of the other of the at least two screens 212 on the exterior side 216*b* of the panel 216.

The plurality of circular elements 218, the first planar element 178, the plurality of contoured elements 162, and the second planar element 180 positioned on and around the furniture screen 210 have the same height such that, when the upholstery is applied around the furniture screen 210, a continuous surface is formed. The plurality of clips 142 are positioned within the gaps 182 formed between the plurality of circular elements 218, the first planar element 178, the plurality of contoured elements 162, and the second planar element 180 as positioned on and around the furniture screen 210, as shown in FIG. 19.

The use of the plurality of circular elements 218, the first planar element 178, the plurality of contoured elements 162, and the second planar element 180 may vary depending on the portions of the furniture 210 that the upholstery is applied. For example, if the upholstery method and system 141 is applied only to the interior sides 216*a* of the panels 216 of the at least two screens 212, then the first planar element 178, the second planar element 180, and the plurality of contoured elements 162 positioned along the interior corner 154 may only be used and the plurality of circular elements 218 are not used.

The at least one piece of fabric 184 (not shown) may then be positioned over and wrapped around the furniture screen 210 using the method described above for the non-corner furniture unit 104. The at least one piece of fabric 184 may include additional sections to accommodate the configuration of the plurality of circular elements 218, the first planar element 178, the plurality of contoured elements 162, and the second planar element 180 positioned on the furniture screen 210.

Screen Connector

Figure 20:
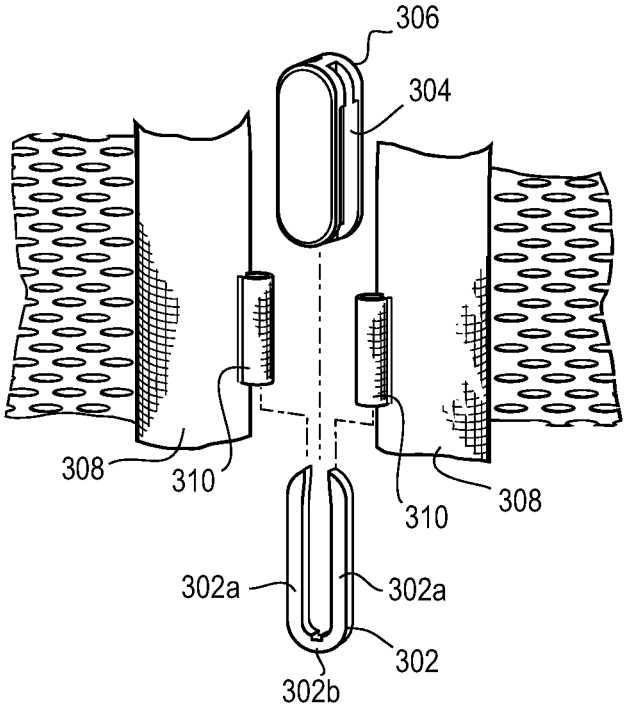
FIG. 20 shows a perspective view of an embodiment of a furniture screen connector for connecting two furniture screens in a non-connected position.

FIGS. 20-22F show an embodiment of a connector 300 that connects two adjacent screens or two adjacent elements of furniture. The connector 300 may be used with the embodiment of the furniture screen 210 described above or other types of furniture screens and elements. The connector 300 is described herein to connect two adjacent screens; however, one of skill in the art knows that the connector 300 may be used in other applications for connecting two adjacent surfaces including two adjacent elements of furniture. FIGS. 20 and 22A show the connector 300 in an unconnected position, and FIGS. 21A-21B and 22B-22F show the screen connector 300 in a connected position.

Each screen connector 300 includes a clip 302 and a housing 304. The clip 302 has a generally U-shape with two parallel members 302*a* and one horizontal member 302*b*, wherein the horizontal member 302*b* connects the two parallel members 302*a*. The housing 304 has a generally circular or oval shape and includes a cavity or recess 306 for insertion of the clip 302. The cavity 306 includes a shape to accommodate the clip 302 such that when the clip 302 is fully inserted into the cavity 306, the clip 302 does not extend beyond an outer perimeter of the housing 304, as shown in FIGS. 21A and 22B-22F. In other embodiments, the housing 304 may have a different shape, such as a square or rectangular shape, wherein the shape of the cavity 306 remains the same for insertion of the clip 302.

Each screen 308 of the two adjacent screens includes a loop 310 to engage the screen connector 300. One of the two parallel members 302*a* of the clip 302 is inserted into the loop 310 of one screen 308 to engage the first of the adjacent screens 308, and the second of the two parallel members 302*a* of the clip 302 is inserted into the loop 310 of the other adjacent screen 308 to engage the second of the adjacent screens 308, as shown in FIGS. 20 and 21B. The housing 304 is then positioned over the two parallel members 302*a* of the clip 302 with the cavity 306 facing the two parallel members 302*a*, and the clip 302 is inserted into the cavity 306 of the housing 304.

When the clip 302 is fully inserted within the cavity 306 of the housing 304, the clip 302 is removably attached to the housing 304 such that the clip 302 and the housing 304 remain connected until the connection is disengaged. For example, the clip 302 and the housing 304 may be connected via a snap fit such that pulling on the clip 302 and/or the housing 304 with sufficient force will remove the connection, and the clip 302 and the housing 304 may be subsequently reconnected. In another embodiment, the housing 304 may include a lock (not shown) that the clip 302 engages when fully inserted into the housing 304. The housing 304 may also include a trigger, switch, lever, or other mechanical element (not shown) that may be used to disengage the lock and allow the clip 302 and the housing 304 to be separated, and the clip 302 and the housing 304 may be subsequently reconnected.

Figure 21A:
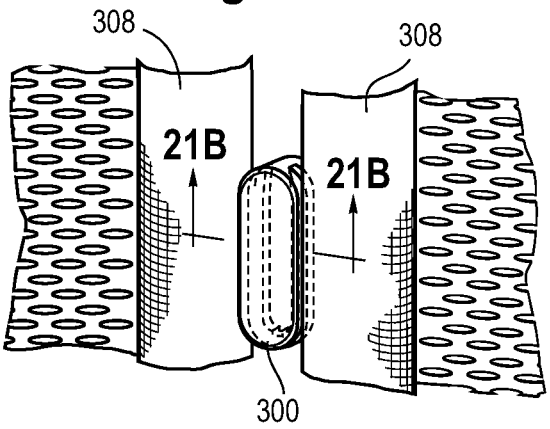
FIG. 21A shows a perspective view of the screen connector of FIG. 20 in a connected position.
Figure 21B:
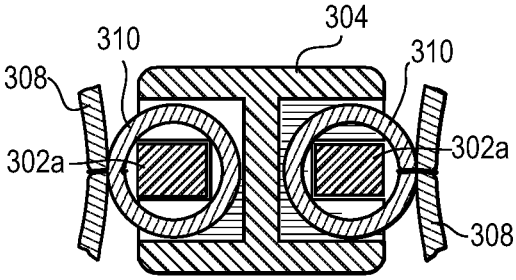
FIG. 21B shows a transverse cross-sectional view of the screen connector of FIG. 21A in the connected position taken along line 21B-21B.
Figure 22A:
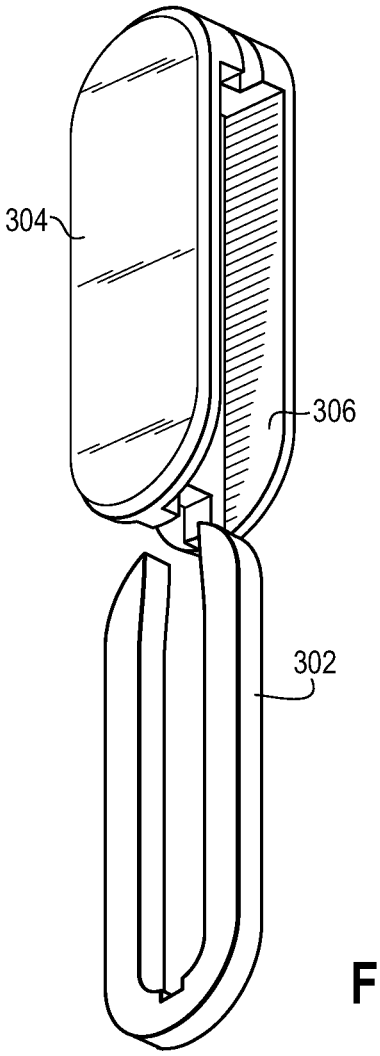
FIG. 22A shows an exploded perspective view of the screen connector of FIG. 20 in the non-connected position.
Figure 22B:
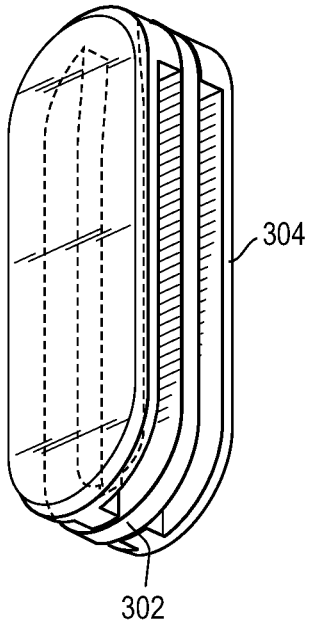
FIG. 22B shows an exploded perspective view of the screen connector of FIG. 20 in the connected position.
Figure 22C:
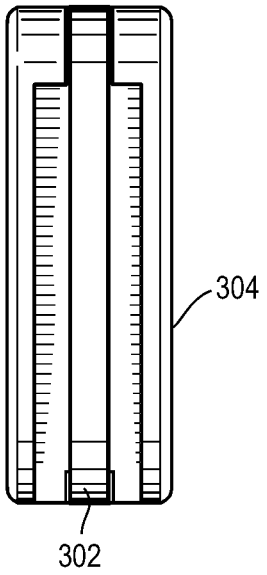
FIG. 22C shows a side view of the screen connector of FIG. 20 in the connected position.
Figure 22D:
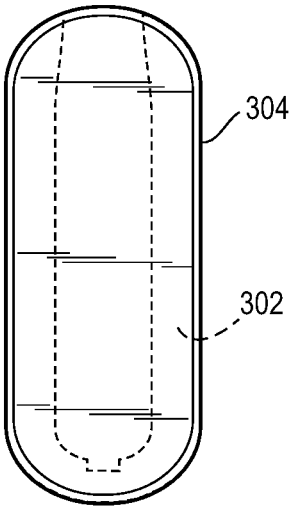
FIG. 22D shows a front view of the screen connector of FIG. 20 in the connected position.
Figure 22E:
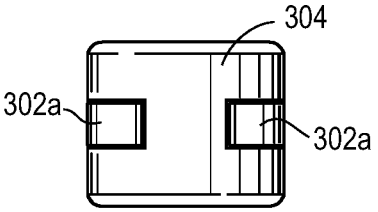
FIG. 22E shows a top view of the screen connector of FIG. 20 in the connected position.
Figure 22F:
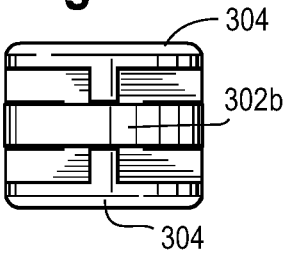
FIG. 22F shows a bottom view of the screen connector of FIG. 20 in the connected position.

FIG. 21A shows a perspective view of the screen connector 300 in the connected position, and FIG. 21B shows a transverse cross-sectional view of the screen connector 300 of FIG. 21A in the connected position taken along line 21B-21B. FIG. 22A shows a bottom perspective view of the screen connector 300 in the unconnected position, and FIG. 22B shows a bottom perspective view of the screen connector 300 in the connected position. FIG. 22C shows a side view of the screen connector 300 in the connected position. FIG. 22D shows a front cross-sectional view of the screen connector 300 in the connected position and the dashed line shows the outline of the clip 302 within the housing 304. FIG. 22E shows a top view of the screen connector 300 in the connected position, and FIG. 22F shows a bottom view of the screen connector 300 in the connected position.

Frame Glide

FIGS. 23A-25C show an embodiment of a frame glide 400 that is connected to a furniture frame or leg that engages a floor surface. When the frame glide 400 is connected to a furniture frame and the furniture frame is positioned on a floor surface, the frame glide 400 separates the furniture frame from the floor surface. The frame glide 400 may protect the floor surface from any damage caused by the furniture and/or to allow the furniture to be easily pushed, pulled or otherwise moved along the floor surface. The frame glide 400 may be used on the support frame 116 of the modular furniture system 100 described above. The furniture glide 400 is described below as for use on the support frame 116; however, one of skill in the art knows that the furniture glide 400 described herein may be used with other furniture frames.

Figure 23A:
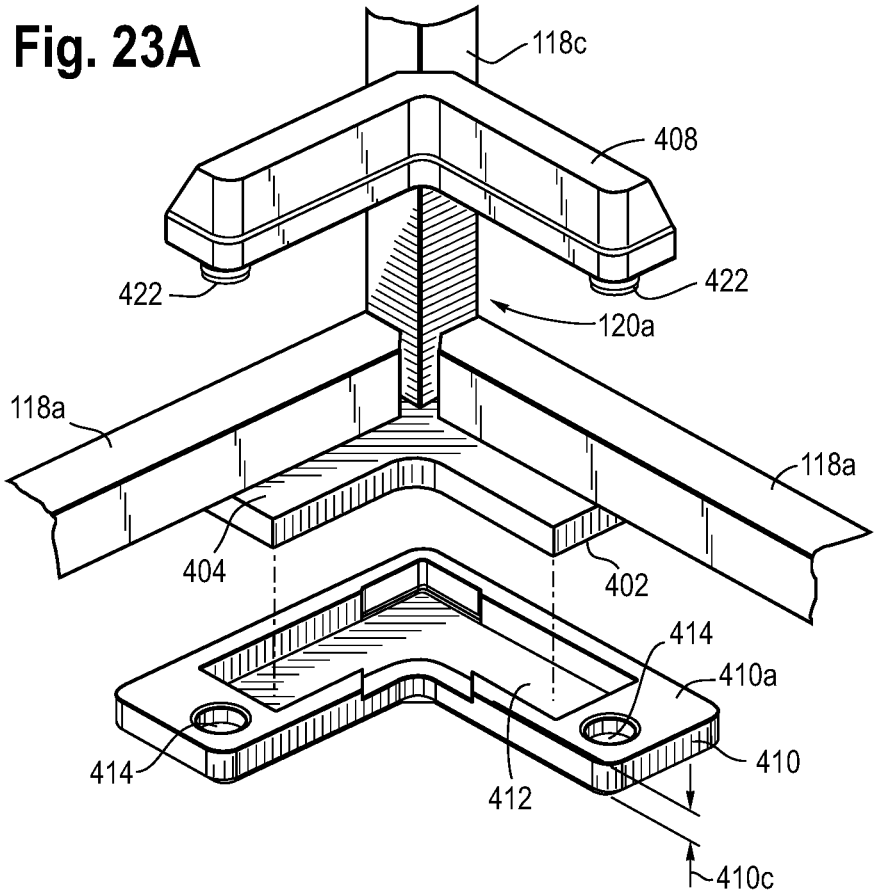
FIG. 23A shows a top perspective view of an embodiment of a frame glide for a furniture unit in a non-connected position.

FIG. 23A shows an exploded perspective view of the corner of the support frame 116 and the frame glide 400. As described above, the support frame 116 includes the plurality of bars 118. A corner 120*a* of the base portion 120 of the support frame 116 includes two of the bars 118*a* from the base portion 120 and one of the vertical bars 118*c*. The two bars 118*a* are each positioned to form an approximately 90-degree angle with the vertical bar 118*c*, and the two bars 118*a* form a generally L-shape with each other. The bars 118*a*, 118*c* of the support frame 116 are connected together at the corner 120*a* via welding.

A bracket 402 may also be welded to the bars 118*a*, 118*c* at the corner 120*a* of the base portion 120 of the support frame 116 to add stiffness, rigidity and strength to the support frame 116. The material of the bracket 402 may include any type of metal such as sheet metal, iron or carbon and/or any type of alloy such as steel. Other materials for the bracket 402 known in the art may be used that allow for the bracket 402 to connect to the bars 118*a*, 118*c* via welding.

Figure 23B:
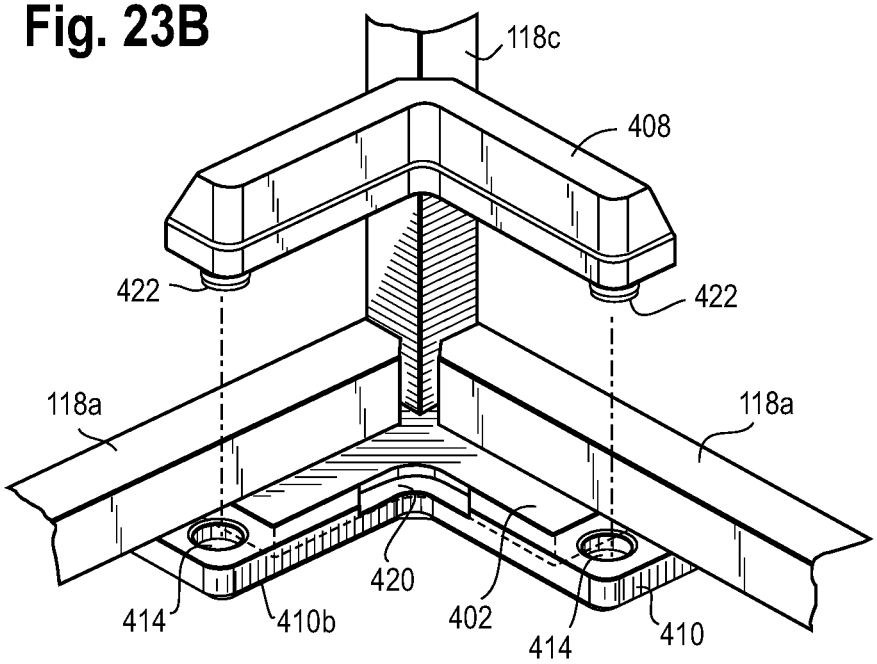
FIG. 23B shows another top perspective view of the frame glide of FIG. 23A in the non-connected position.
Figure 24:
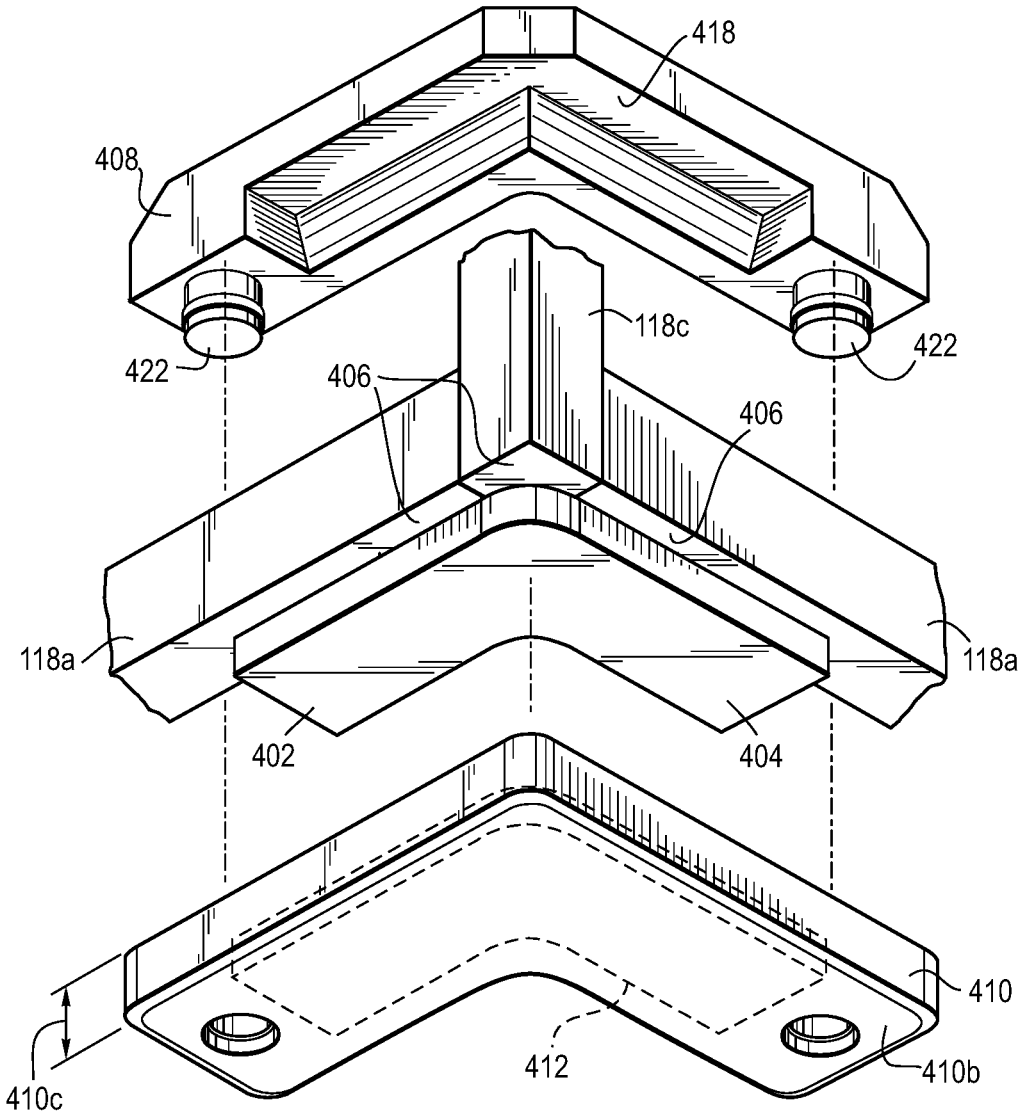
FIG. 24 shows a bottom perspective view of the frame glide of FIG. 23A in the non-connected position.

The bracket 402 includes a generally L-shape to be positioned under the bars 118*a*, 118*c*. In other words, when the support frame 116 is positioned on a floor surface, the bracket 402 separates the support frame 116 from the floor surface prior to positioning the frame glide 400 on the support frame 116. When the bracket 402 is positioned under the bars 118*a*, 118*c*, a portion 404 of the bracket 402 extends beyond the perimeter of the bars 118*a*, as shown in FIGS. 23B and 24. Specifically, the corner 120*a* of the base portion 120 of the support frame 116 forms an interior corner where the bars 118*a* form an approximately 90-degree angle with each other, and the corner 120*a* also forms an exterior corner where the bars 118*a* form an approximately 270-degree angle with each other. The bracket 402 extends beyond the perimeter of the bars 118*a* in a direction away from the interior corner of the corner 120*a* where the bars 118*a* are connected and toward the center of the base portion 120 of the support frame 116. The bracket 402 is also positioned under the bars 118*a*, 118*c* such that a portion 406 of each of the bars 118*a*, 118*c* is exposed at the corner 120*a*, as shown in FIG. 24.

Figure 25A:
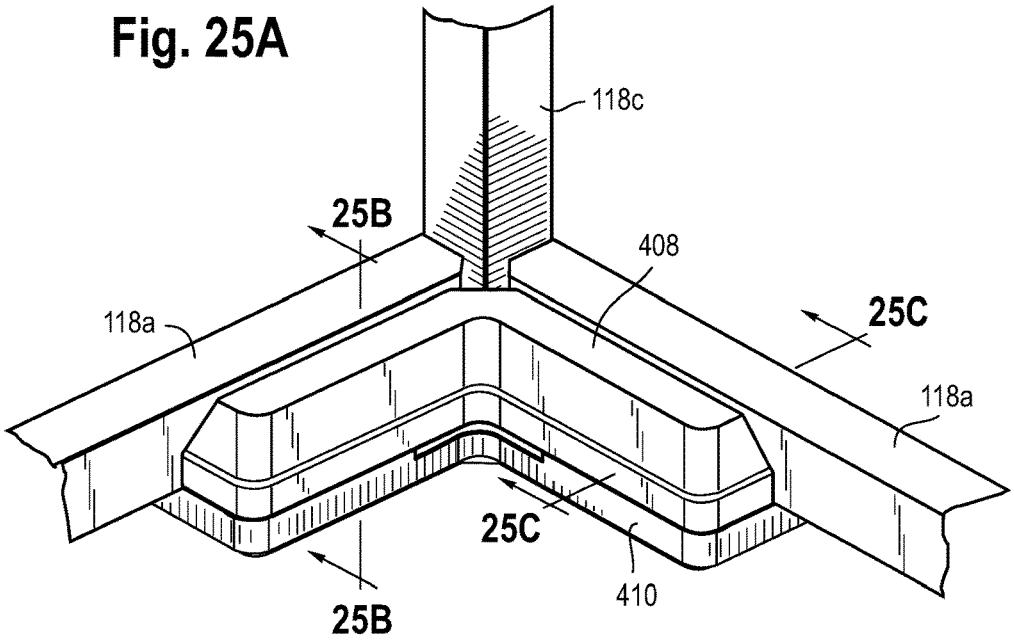
FIG. 25A shows a top perspective view of the frame glide of FIG. 23A in a connected position.
Figure 25B:
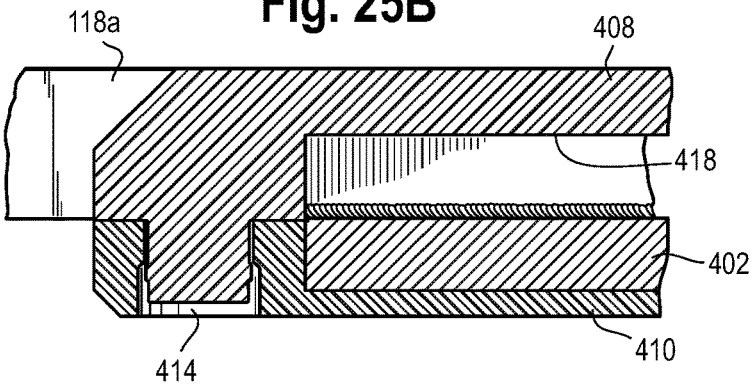
FIG. 25B shows a cross-sectional partial view taken along line 25B-25B of FIG. 25A.

The frame glide 400 includes a first or upper portion 408 and a second or bottom portion 410. The material of the first and second portions 408, 410 may include any type of plastic including nylon plastic, low and high-density polyethylene, polypropylene, and polystyrene. The first portion 408 and the second portion 410 of the frame 400 may be removably connected to each other to allow the frame glide 400 to be connected to the support frame 118 and to be removed from the support frame 118. In one embodiment, both of the first and second portions 408, 410 may be connected and removed from the support frame 118. In a second embodiment, described herein, the first portion 408 of frame glide 400 is connected to the support frame 118 via welding, and the second portion 410 of the frame glide 400 may be removably connected to the first portion 408 and from the support frame 118. As shown in FIG. 25A, when the frame glide 400 is connected to the support frame 118 and the support frame 118 is positioned on a floor surface, the second portion 410 of the frame glide 400 engages the floor surface, and the first portion 408 of the frame glide does not engage the floor surface.

Figure 25C:
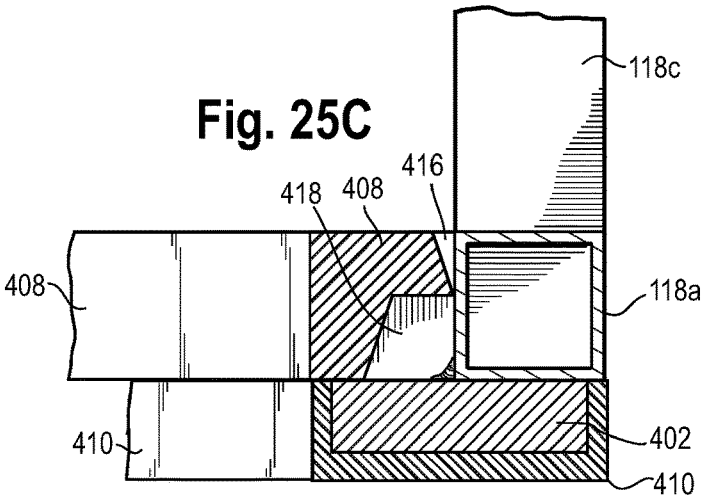
FIG. 25C shows a cross-sectional view taken along line 25C-25C of FIG. 25A.

The second portion 410 of the frame glide 400 has a generally L-shape that includes a top surface 410*a*, a bottom surface 410*b*, and a thickness 410*c*. In other words, when the support frame 116 is positioned on a floor surface, the bottom surface 410*b* of the second portion 410 of the frame glide 400 engages the floor surface. The thickness 410*c* of the second portion 410 of the frame glide 400 may vary to adjust the distance between the floor surface and the support frame 116. As shown in FIG. 23A, the second portion 410 includes a recess 412 within the top surface 410*a*. The recess 412 also includes a generally L-shape and is dimensioned to accommodate the bracket 402. The bracket 402 is inserted into the recess 412 of the second portion 410, and the bracket 402 is connected to the second portion 410 via a snug or snap fit. As shown in FIG. 25C, the second portion 410 of the frame glide 400 is positioned under the bars 118*a*, 118*c* to cover the portion 406 of each of the bars 118, 118*c* previously exposed at the corner 120*a*.

The second portion 410 of the frame glide 400 also includes at least two cavities or holes 414 to engage the first portion 408 of the frame glide 400 described below. The at least two cavities or holes 414 provide for a snap fit connection between the first portion 408 and the second portion 410 of the frame glide 400 and have a generally circular shape. The second portion 410 of the frame glide 400 also includes a slotted recess 420 that provides a surface to separate the first and second portions 408, 410 of the frame glide 400 after they are connected to each other. For example, a straight slot screwdriver may be inserted into the slotted recess 420 and rotated to separate the first and second portions 408, 410 from each other.

The first portion 408 of the frame glide 400 has a generally L-shape, as shown in FIGS. 23A-25A. The first portion 408 includes a top surface 408*a* and a bottom surface 408*b*. In other words, the bottom surface 408*b* of the first portion 408 connects to the second portion 410 of the frame glide, and the top surface 408*a* of the first portion 408 does not connect to the second portion 410 of the frame glide. As shown in FIG. 25A, the first portion 408 of the frame glide 400 is positioned within and against the interior corner of the corner 120*a* of the bars 118*a*, 118*c*. The side surfaces of the first portion 408 of the frame glide 400 that are adjacent to the bars 118*a*, 118*c* may be angled, such as shown in FIG. 25C, to create a gap 416 that allows for the first portion 408 of the frame glide 400 to be welded to the support frame 118 if a permanent connection of the first portion 408 to the support frame 118 is desired. The first portion 408 of the frame glide 400 also includes a cutout or recess 418, as shown in FIG. 24, which also allows for the first portion 408 of the frame glide 400 to be welded to the support frame 118 if a permanent connection is desired. The cutout or recess 418 has a generally square shape to accommodate the weld, and in other embodiments, the cutout or recess 418 may include a different shape that is capable of accommodating a weld.

FIGS. 23A-24 and 25B show that the first portion 408 of the frame glide 400 also includes at least two protruding elements 422 that protrude from the bottom surface 408*b* of the first portion 408. Each of the at least two protruding elements 422 has a generally circular shape. The at least two protruding elements 422 allow for the connection between the first and second portions 408, 410 of the frame glide. Specifically, the at least two protruding elements 422 of the first portion 408 are inserted into the at least two cavities 414 of the second portion 410 and connect the first portion 408 to the second portion 410 via a snap fit.

This application also includes a device for connecting adjacent elements of furniture, the device comprising: a housing and a clip removably connected to each other; wherein the housing comprises a cavity to accommodate the clip; wherein the clip comprises two parallel members connected by a horizontal member; and wherein one of the two parallel members of the clip is removably connected to one of the adjacent elements of furniture, and wherein the other of the two parallel members of clip is removably connected to the other of the adjacent elements of furniture. This application further includes a furniture glide comprising: a first portion and a second portion that are removably connected to each other; wherein the first portion comprises a top surface, a bottom surface, and at least two protruding elements that extend from the bottom surface; wherein the second portion comprises a top surface, a bottom surface, and at least two cavities formed within the top surface; wherein the at least two protruding elements are aligned with the at least two cavities such that the first and second portions are removably connected to each other via the connection between the at least two protruding elements and the at least two cavities; and wherein the recess of the second portion provides a surface for the first and second portions to be removed from each.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Although specific terms are employed herein, they are used in a generic and descriptive sense only and not for purposes of limitation unless specifically defined by context, usage, or other explicit designation. It is therefore intended that the foregoing detailed description be regarded as illustrative rather than limiting. In addition, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment. In the event of any inconsistent disclosure or definition from the present application conflicting with any document incorporated by reference, the disclosure or definition herein shall be deemed to prevail.

We claim:

1. An upholstery system for forming a curved surface, the system comprising:

two surfaces that form a corner;

first and second planar elements, wherein each planar element is positioned on one of the two surfaces;

a plurality of contoured elements positioned between the first and second planar elements and along the corner, wherein each of the plurality of contoured elements comprises a curved surface;

at least one piece of fabric, wherein the at least one piece of fabric comprises at least three sections, and wherein the at least three sections are connected to each other in a series such that adjacent sections form a connected portion; and a plurality of clips positioned on each of the two surfaces so that at least one clip is disposed between the first planar element and the plurality of contoured elements and at least one clip is disposed between the second planar element and the plurality of contoured elements;

wherein the at least three sections of the at least one piece of fabric are positioned over the planar elements and the plurality of contoured elements; and wherein the connected portion of adjacent sections of the at least one piece of fabric is connected to the plurality of clips.

2. The upholstery system of claim 1, wherein a first section of fabric of the at least three sections is positioned over one of the planar elements, a second section of fabric is positioned over the curved surface of the plurality of contoured elements, and a third section of fabric is positioned over the other of the planar elements.

3. The upholstery system of claim 2, wherein the connected portion of the first and second sections of fabric is connected to the plurality of clips between the first planar element and the plurality of contoured elements; and wherein the connected portion of the second and third sections of fabric is connected to the plurality of clips between the plurality of contoured elements and the second planar element.

4. The upholstery system of claim 1, further comprising a curved element that is positioned over the curved surface of the plurality of contoured elements.

5. The upholstery system of claim 1, further comprising a bar that is connected to the connected portion of adjacent sections of fabric.

6. The upholstery system of claim 5, wherein the bar is connected to the plurality of clips.

7. The upholstery system of claim 1, wherein the curved surface of the plurality of contoured elements comprises a concave surface.

8. The upholstery system of claim 1, wherein the curved surface of the plurality of contoured elements comprises a convex surface.

9. The upholstery system of claim 1, wherein the two surfaces that form a corner comprise a seat surface and a back surface of furniture.

10. The upholstery system of claim 9, wherein the seat surface and the back surface comprise a task chair.

11. The upholstery system of claim 1, wherein the two surfaces that form a corner comprise two furniture screens.

12. An upholstery system for forming a curved surface, the system comprising:

three surfaces that form three corners, wherein first and second of the three surfaces form the first corner, the first and third surfaces form the second corner, and the first, second, and third surfaces form the third corner;

first, second, and third planar elements, wherein each planar element is positioned on one of the three surfaces;

a plurality of contoured elements positioned along the first corner between the first and second planar elements and along the second corner between the first and third planar elements, wherein each of the plurality of contoured elements comprises a curved surface;

a plurality of clips positioned on each of the three surfaces so that at least one clip is disposed between the first planar element and the plurality of contoured elements, at least one clip is disposed between the plurality of contoured elements and the second planar element, at least one clip is disposed between the plurality of contoured elements and the third planar element, and at least one clip is disposed between the second and third planar elements;

at least one piece of fabric, wherein the at least one piece of fabric comprises at least four sections of fabric, and wherein the at least four sections of the at least one piece of fabric are connected to cover the three planar elements and the plurality of contoured elements, wherein adjacent sections of fabric form a connected portion; and wherein the connected portion of adjacent sections of fabric is connected to the plurality of clips.

13. The upholstery system of claim 12, wherein the system further comprises a curved element comprising three portions, with a first and a third of the three portions positioned over the plurality of contoured elements, and a second of the three portions positioned over the third corner.

14. The upholstery system of claim 12, wherein the system further comprises a bar connected to the connected portion of adjacent sections of fabric.

15. The upholstery system of claim 14, wherein the bar is connected to the plurality of clips.

16. The upholstery system of claim 12, wherein the curved surface of the plurality of contoured elements comprises a concave surface.

17. The upholstery system of claim 12, wherein the curved surface of the plurality of contoured elements comprises a convex surface.

18. The upholstery system of claim 12, wherein the first surface comprises a seat surface and the second and third surfaces each comprise a back surface of furniture.

19. An upholstery method for forming a curved surface, the method comprising:

presenting two surfaces that form a corner;

presenting two planar elements;

positioning each planar element on one of the two surfaces;

presenting a plurality of contoured elements;

positioning the plurality of contoured elements between the two planar elements and along the corner, wherein each of the plurality of contoured elements comprises a curved surface;

presenting a plurality of clips;

positioning the plurality of clips on the two surfaces between a first of the two planar elements and the plurality of contoured elements and between a second of the two planar elements and the plurality of contoured elements;

presenting a piece of fabric comprising at least three sections;

connecting the three sections of fabric to each other in a series such that adjacent sections of fabric form a connected portion;

positioning the three sections of fabric over the curved surfaces of the two planar elements and the plurality of contoured elements; and connecting the connected portion of adjacent sections of fabric to the plurality of clips.

20. The upholstery method of claim 19, wherein the positioning of the three sections of fabric comprises positioning a first section of fabric of the at least three sections over one of the planar elements; positioning a second section of fabric over the plurality of contoured elements; and positioning a third section of fabric over the second of the planar elements.

21. The upholstery method of claim 20, wherein the connecting of the connected portion of adjacent sections of fabric to the plurality of clips comprises:

connecting the connected portion of the first and second sections of fabric to the plurality of clips between the first planar element and the plurality of contoured elements; and connecting the connected portion of the second and third sections of fabric to the plurality of clips between the plurality of contoured elements and the second planar element.

* * * * *